US006860845B1

(12) United States Patent
Miller et al.

(10) Patent No.: US 6,860,845 B1
(45) Date of Patent: Mar. 1, 2005

(54) SYSTEM AND PROCESS FOR SEPARATING MULTI PHASE MIXTURES USING THREE PHASE CENTRIFUGE AND FUZZY LOGIC

(76) Inventors: Neal J. Miller, 920 Lakeview La., Casper, WY (US) 82604; William Jerry Parkinson, 406 Bryce Ave., Los Alamos, NM (US) 87544; Ronald E. Smith, 1441 11th St., Los Alamos, NM (US) 87544

( * ) Notice: Subject to any disclaimer, the term of this patent is extended or adjusted under 35 U.S.C. 154(b) by 171 days.

(21) Appl. No.: 10/051,324

(22) Filed: Jan. 22, 2002

Related U.S. Application Data

(63) Continuation-in-part of application No. 09/357,339, filed on Jul. 14, 1999, now abandoned.

(51) Int. Cl.[7] ..... B04B 1/20; B04B 13/00

(52) U.S. Cl. ..... 494/1; 494/13; 494/37; 494/53; 494/901; 700/273; 706/900

(58) Field of Search ..... 706/50, 1, 900; 494/1, 5, 7–10, 13, 37, 38, 42, 50–54, 56, 57, 901; 700/273; 210/96.1, 143, 380.1, 380.3, 739, 781, 787

(56) References Cited

U.S. PATENT DOCUMENTS

| | | | | |
|---|---|---|---|---|
| 3,623,656 A | | 11/1971 | Lavanchy | |
| 4,299,353 A | | 11/1981 | Bruning et al. | |
| 4,700,117 A | * | 10/1987 | Giebeler et al. | 494/10 |
| 5,156,751 A | | 10/1992 | Miller | |
| 5,306,225 A | | 4/1994 | Miyano et al. | |
| 5,499,586 A | * | 3/1996 | Davis | |
| 5,561,993 A | * | 10/1996 | Elgersma et al. | 494/82 |
| 5,681,256 A | | 10/1997 | Nagafuji | |
| 5,857,955 A | | 1/1999 | Phillips et al. | |
| 5,899,844 A | | 5/1999 | Eberle, Sr. | |
| 5,948,271 A | | 9/1999 | Wardwell et al. | |
| 6,063,292 A | | 5/2000 | Leung | |
| 6,350,224 B1 | * | 2/2002 | Cordaro et al. | 494/7 |
| 6,635,007 B2 | * | 10/2003 | Evans et al. | 494/7 |
| 2002/0000781 A1 | * | 1/2002 | Glen | |

FOREIGN PATENT DOCUMENTS

| | | | |
|---|---|---|---|
| FR | 2771659 | * | 6/1999 |
| WO | 99/28040 | * | 6/1999 |

OTHER PUBLICATIONS

Parkinson, William J. et al., "A Fuzzy Controlled Three–Phase Centrifuge for Waste Separation", May 1998, pp. 1–6. Paper presented at the World Automation Congress in Anchorage, Alaska.

Parkinson, William J. et al., "A Fuzzy Control System for a Three–Phase Oil Field Centrifuge", Aug. 1998, pp. 1–5. Paper presented at the 2nd international conference for Engineering Design and Automation (EDA).

Parkinson, William J., "Fuzzy and Probabilistic Control Techniques Applied to Problems of the Chemical Process Industries", thesis, Jul. 2001, Los Alamos National Laboratory, Los Alamos, New Mexico, pp. 1–364.

* cited by examiner

*Primary Examiner*—Charles E. Cooley
(74) *Attorney, Agent, or Firm*—Stephen A. Gratton

(57) ABSTRACT

A system for separating a multi phase mixture into a first liquid phase component, a second liquid phase component and a solid phase component includes a three phase centrifuge and a control system for the centrifuge. The control system includes a fuzzy soft sensor programmed with fuzzy logic rules and a feed forward controller in signal communication with the fuzzy soft sensor. The feed forward controller is configured to adjust a feed rate and a feed temperature of the mixture based on the rules, the cold feed temperature, the percent change of water in the mixture, and the percent change of solids in the mixture. The system also includes a feedback controller configured to adjust the feed rate and the feed temperature of the mixture based on the rules, and the basic water and solid (BS&W) content of the first liquid phase component.

29 Claims, 11 Drawing Sheets

SYSTEM AND PROCESS FOR SEPARATING MULTI PHASE MIXTURES USING THREE PHASE CENTRIFUGE AND FUZZY LOGIC

CROSS-REFERENCE TO RELATED APPLICATIONS

This application is a continuation-in-part of Ser. No. 09/357,339, filed July 14, 1999, now abandoned.

FIELD OF THE INVENTION

This invention relates generally to chemical processing, and more particularly to a system and to a process for separating three phase mixtures, such as crude oil, into separate components.

BACKGROUND OF THE INVENTION

In the Chemical Processing Industries (CPI) process control is an important consideration. Issues associated with process control are often complex and non-linear and require human judgment and experience.

One example of a chemical process with control issues occurs during waste separation processes in the petroleum industry. For example, in the production of crude oil, contaminants in the solid phase and contaminants in the liquid phase may be present in a mixture containing the oil. Excessive levels of contaminants yield a final product that is non-usable. In addition, contaminated crude oil can be difficult to dispose of in an environmentally safe manner.

One separation system for oil mixtures includes a three stage centrifuge which mechanically separates the contaminants from the oil. U.S. Pat. No. 5,156,751 to Miller discloses this type of system. The control of such a system is difficult because there are several variables that affect the separation process and the purity of the final product. These variables are difficult to model and incorporate into a control system for the centrifuge.

For example, the oil mixture enters the centrifuge as a meta-stable emulsion containing two liquid phases (oil and water) and a solid phase (solids). The physical properties of the mixture required for modeling the control system, are variable and not well understood. In addition, the mechanics of the centrifuge introduce variables that are also difficult to characterize and quantify. The centrifuge includes a tapered bowl and an internal conveyor auger rotating at different rotational speeds. The solids and the oil separate from the water at different rates depending on the rotational speeds of the bowl and the auger. Further, the feed rate and the temperature of the oil mixture, the size of the solids, and the type of the oil, also affect the separation process. In addition, during the separation process the oil and the water can interact in an unpredictable manner. Even a simple model of this system does not represent it well enough to be used for control purposes.

In view of the multitude of variables, in the past a skilled operator with broad experience and intuitive knowledge is required to successfully operate the separation system. However, skilled operators are difficult to train, and expensive to pay. It would be advantageous to utilize the experience and intuitive knowledge of a skilled operator to formulate an automated control system for the separation system.

The present invention recognizes that fuzzy logic techniques can be utilized to construct an automated control system that simulates the experience and judgment of a skilled operator. Rather than modeling the system, the fuzzy logic models the skilled operator.

SUMMARY OF THE INVENTION

In accordance with the present invention, a system and a process for separating a multi phase mixture, such as an oil emulsion, into separate components are provided. The system includes a three phase centrifuge configured to separate the mixture into a first liquid phase component (oil), a second liquid phase component (water) and a solid phase component (solids).

The system also includes a control system configured to measure process variables and to control process parameters. The control system includes a fuzzy soft sensor programmed with a set of fuzzy logic rules, and a feed forward controller in signal communication with the fuzzy soft sensor. The fuzzy soft sensor and the feed forward controller are configured to adjust process parameters, such as a feed temperature and a feed rate of the mixture, based on the rules and the measured feed forward variables. The system also includes a feedback controller configured to adjust process parameters based on the rules and measured feed back variables, such as the water or oil content of the first and second liquid phase components.

DETAILED DESCRIPTION OF THE PREFERRED EMBODIMENTS

As used herein, the term "fuzzy logic rule" means a rule that takes it's input from semantic variables that are not normally precisely defined (such as "high", "low", "large", "small") and provides output that can be quantified (e.g., 10 volts, etc.).

As used herein the term "BS&W" is an acronym for basic solids and water content.

The term "multi-phase" mixture means combinations of two or more substances in which each substance retains it own composition and properties. In the illustrative embodiment the multi-phase mixture comprises an oil emulsion containing a first liquid phase component in the form of oil, a second liquid phase component in the form of water, and a solid phase component in the form of sediment or other solid matter. With respect to the liquid phase components one of the components has a higher specific gravity than the other liquid phase component (e.g., water has a higher specific gravity than oil). Also with respect to the liquid phase components, one of the liquid phases can be termed the "continuous phase" in which case the other liquid phase is dispersed in the continuous phase as droplets. For example, if water is the continuous phase, oil droplets are dispersed throughout the water. If oil is the continuous phase, water droplets are dispersed throughout the oil.

Separation System

Figure 1:
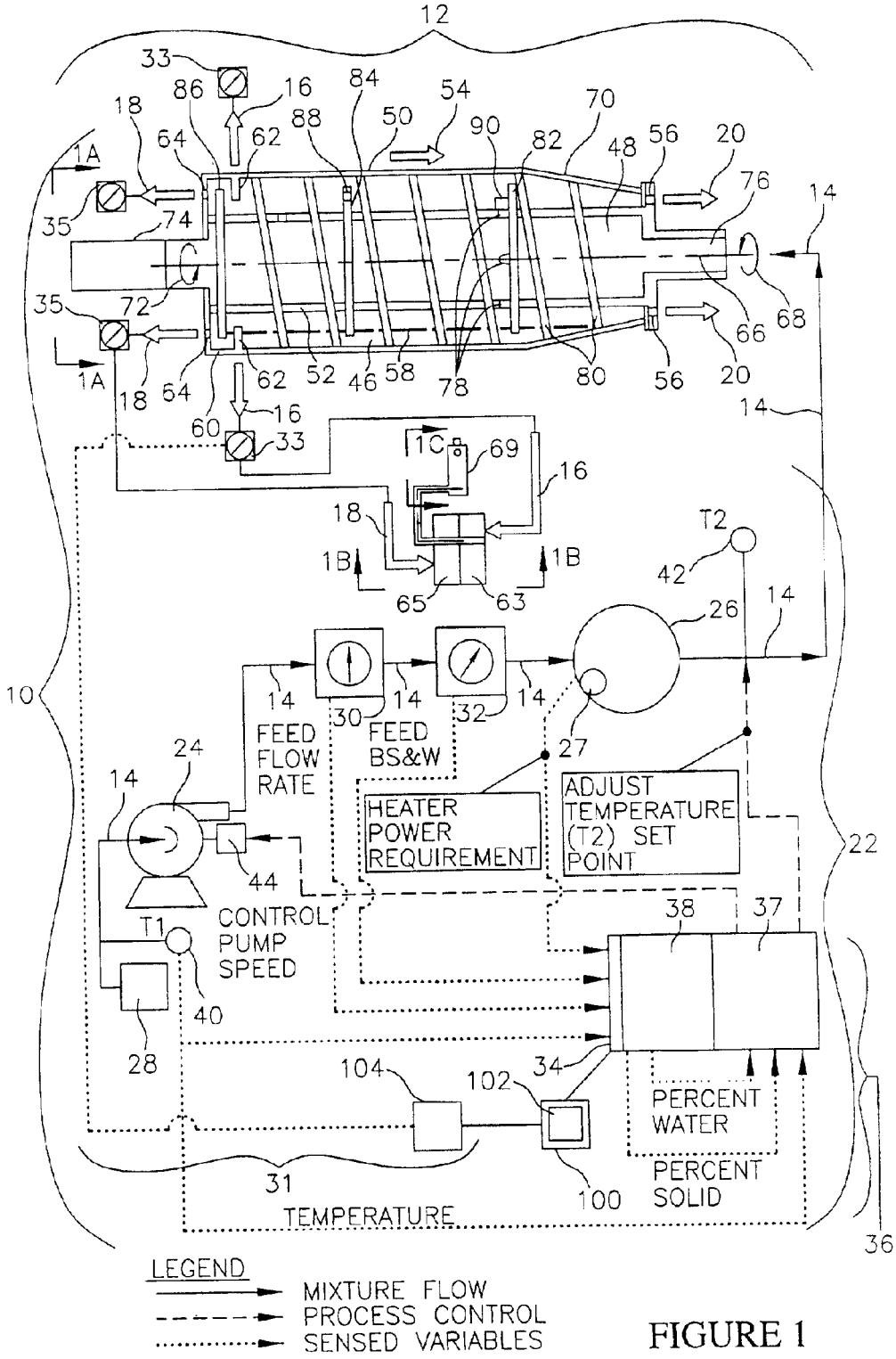
FIG. 1 is a schematic diagram of a separation system including a fuzzy logic control system and centrifuge constructed in accordance with the invention.

Referring to FIG. 1, a separation system 10 constructed in accordance with the invention is illustrated. The separation system 10 is configured to perform a separation process in which a multi phase mixture 14 (oil emulsion) is separated into a first liquid phase component 16 (oil), a second liquid phase component 18 (water) and a solid phase component 20 (solids).

The separation system 10 includes a three phase centrifuge 12 configured to mechanically separate the multi phase mixture 14 into the separate components 16, 18, 20. In addition, the separation system 10 includes a feed pump 24 configured to receive the multi phase mixture 14 (oil emulsion) from a receptacle 28, such as a tank or a pond, and to inject the mixture 14 into the centrifuge 12.

The feed pump 24 preferably comprises a progressive cavity pump configured to move fluids in a laminar flow, or in some cases turbulent flow, with a minimum of trauma. This prevents fracturing and emulsification of the multi phase mixture 14 (oil emulsion). The feed pump 24 also includes a variable drive mechanism 44, such as a variable frequency electric motor, constructed to rotate with a selected revolutions per minute. The speed of the variable drive mechanism 44 is controlled in a manner to be hereinafter described to control the speed, and thus the feed rate, of the feed pump 24. Representative feed rates for the multi phase mixture 14 (oil emulsion) can be from about 5 gallons per minute to about 65 gallons per minute (GPM).

The separation system 10 also includes a heater 26 configured to heat the multi phase mixture 14 (oil emulsion) prior to injection into the centrifuge 12. The heater 26 can comprise a continuous flow electric heater having submersible heater elements configured to heat the multi phase mixture 14 (oil emulsion) responsive to the power applied to the elements. Suitable heater elements are manufactured by Ogden Manufacturing of Arlington Heights, Ill.

As will be further explained, the power applied to the heater elements, which is termed herein the "power requirements" of the heater 26, are controlled to achieve a selected temperature set point (T2) for the multi phase mixture 14 (oil emulsion). A representative temperature range for the temperature set point (T2) can be from about 125° F. to 200° F.

The separation system 10 also includes a fuzzy logic control system 22 configured to control the feed pump 24 to achieve a desired feed flow rate, and the heater 26 to achieve a desired feed temperature set point. The fuzzy logic control system 22 includes a flow meter 30 configured to measure a feed flow rate of the multi phase mixture 14 (oil emulsion). The flow meter 30 can comprise a conventional electronic flow meter which provides data in an electronic or digital format representative of the feed flow rate of the multi phase mixture 14 (oil emulsion). One suitable flow meter is manufactured by Controlotron of Hauppauge, N.Y. and is designated a model no. 191N1S. As will be further explained, the flow meter 30 provides data for controlling the output of the feed pump 24 and the power requirements of the heater 26.

The fuzzy logic control system 22 also includes a first BS&W meter 32 configured to measure the BS&W content of the multi phase mixture 14 (oil emulsion), and a second BS&W meter 33 configured to measure the BS&W content of the first liquid phase component 16 (oil) discharged from the centrifuge 12. Suitable BS&W meters 32, 33 are manufactured by Invalco of Hutchinson, Kans., with a model no. CX-454-200 being suitable for BS&W meter 32, and a model no. CX-645-200 BGP being suitable for BS&W meter 33. As will be further explained, the BS&W meters 32, 33 provide data for controlling the output of the feed pump 24, and the power requirements of the heater 26.

Optionally the fuzzy logic control system 22 can also include a water quality meter 35 configured to measure the percentage of oil in the second liquid phase component 18 (water). As will be further explained, the water quality meter 35 can be used to provide data for controlling the output of the feed pump 24, and the power requirements of the heater 26.

The fuzzy logic control system 22 also includes a first temperature sensor 40 configured to measure a cold feed temperature (T1) of the multi phase mixture 14 (oil emulsion) pumped by the feed pump 24 from the receptacle 28. In addition, a second temperature sensor 42 is configured to measure a temperature set point (T2) of the multi phase mixture 14 (oil emulsion) prior to injection into the centrifuge 12.

The fuzzy logic control system 22 also includes a fuzzy feed back control system 31 configured to detect the BS&W content of the first liquid phase component 16 (oil), and optionally, the oil content of the second liquid phase component 18 (water). As will be further described, this information is then used to ascertain membership in the input membership functions. Using these memberships and the fuzzy rules the feed flow rate is adjusted by changing the power input to the feed pump 24. In addition, the feed temperature is adjusted by setting a new temperature set point (T2). In this regard, the heater 22 includes a hardware standard PID controller 27 configured to adjust the heater power in order to comply with the power required to reach and maintain the temperature set point (T2). With feedback control, this procedure is repeated until the measured product requirements are met or optimized. In the examples to follow the BS&W content of the first liquid phase component 16 (oil) is met or optimized.

The fuzzy logic control system 22 also includes a fuzzy feed forward control system 36 configured to detect changes in measured feed variables (cold feed temperature T1, feed BS&W content, feed flow rate) of the multi phase mixture 14 (oil emulsion). The feed forward control system 36 makes control adjustments before operational problems with the centrifuge 12 occur. In particular the feed forward control system 36 attempts to predict future behavior based upon current feed conditions. It then makes adjustments in advance in preparation for the coming changes, thus optimizing future output. As with the feed back control system 31, the feed forward control system 36 changes the feed flow rate and the temperature set point (T2). Since these are the same variables that the feed back control system 31 changes, conflicts are resolved using a conflict resolution code to be hereinafter described.

Elements of both control systems 31, 36 can be contained in a computer 100 programmed with software containing rules to be hereinafter described. Input data from both control systems 31, 36 is quantified using the rules to make control adjustments.

Centrifuge

As shown in FIG. 1, the centrifuge 12 includes a rotatable bowl 50 and a conveyor auger 52. The rotatable bowl 50 is generally cylindrical in shape and has a hollow interior portion 46. Similarly, the conveyor auger 52 has a hollow interior portion 48. The three phase mixture 14 (oil emulsion) is pumped by the feed pump 24 through the interior portion 48 of the conveyor auger 52, and into the interior portion 46 of the rotatable bowl 50.

The rotatable bowl 50 is journaled on heavy duty bearings (not shown) and is rotated by a drive motor (not shown). The rotatable bowl 50 rotates about a longitudinal axis 66 thereof, in a clock wise direction as indicated by arrow 68. A representative rotational speed of the rotatable bowl 50 is from 500 rpm to 3500 rpm. This rotation imparts centrifugal forces on the multi phase mixture 14 (oil emulsion) of about 700–1000 g's. The centrifugal forces separate the multi phase mixture 14 (oil emulsion) into the first liquid phase component 16 (oil), the second liquid phase component 18 (water) and the solid phase component 20 (solids).

During the separation process centrifugal forces in the rotatable bowl 50 move the solid phase component 20 (solids) towards the outer diameter of the rotatable bowl 50 where it is pushed as indicated by arrow 54 by the conveyor auger 52. In addition, the conveyor auger 52 pushes the solid phase component 20 (solids) through one or more solids discharge ports 56 that are in flow communication with the interior portion 46 of the rotatable bowl 50 and with the atmosphere. At the solids discharge ports 56 the solid phase component 20 (solids) can be collected in a suitable receptacle (not shown) for disposal or other use.

Because the first liquid phase component 16 (oil) and the second liquid phase component 18 (water) have different specific gravities, separate pools of these components form within the interior portion 46 of the rotatable bowl 50. In particular, the first liquid phase component 16 (oil) and the second liquid phase component 18 (water) are separated by the centrifugal forces along a line of separation 58, and are discharged at a fluid discharge end 60 of the rotatable bowl 50. The first liquid phase component 16 (oil) is discharged from elongated discharge tubes 62 located at a pool depth to contact only the first liquid phase component 16 (oil). The discharge tubes 62 are in fluid communication with a first catch tank 63 (oil) which collects the first liquid phase component 16 (oil).

Figure 1A:
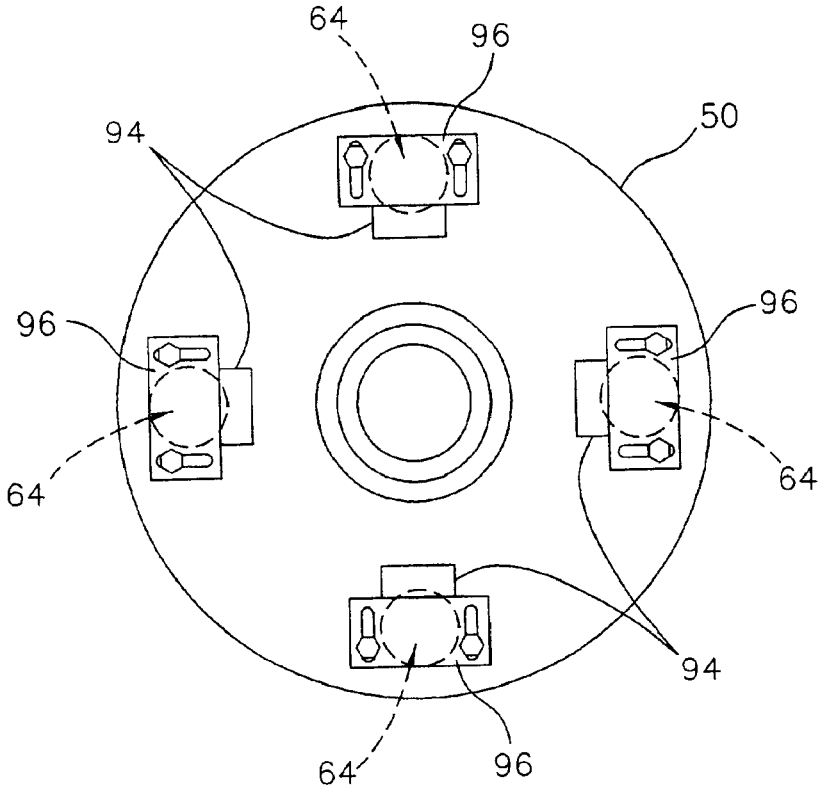
FIG. 1A is a schematic end view of the centrifuge taken along line 1A—1A of FIG. 1.

The second liquid phase component 18 (water) is discharged from weirs 64 located at a pool depth to contact only the second liquid phase component 18 (water). As shown in FIG. 1A, the weirs 64 are formed on an end plate 92 of the rotatable bowl 50. Specifically, the end plate 92 includes four generally rectangular shaped openings 94, and slotted plates 96 partially cover the openings 94. The locations of the slotted plates 96 can be adjusted as required to a selected pool depth for withdrawing the second liquid phase component 18 (water). The weirs 64 are in fluid communication with a second catch tank 65 (water) which collects the second liquid phase component 18 (water). In addition, a vapor recovery unit 69 collects and recovers vapor from the first catch tank 63 (oil) and the second catch tank 65 (water). The structure and function of the vapor recovery unit 69 will be more fully described as the description proceeds.

The rotatable bowl 50 includes a tapered beach 70 of reduced cross section proximate to an inlet 76 of the conveyor auger 52. The tapered beach 70 provides an annulus of reduced cross section which during operation of the centrifuge fills partially with the second liquid phase component 18 (water). The tapered beach 70 can be lined with a smooth non-porous material such as ceramic tiles. This smooth surface provides reduced friction for the solid phase component 20 (solids), which is pushed by the conveyor auger 52 through the beach 70 and out the solids discharge ports 56.

The conveyor auger 52 is concentrically mounted within the rotatable bowl 50 and journaled for rotation about the longitudinal axis 66. The direction of rotation of the conveyor auger 52 is opposite to the direction of the rotation of the rotatable bowl 50 which is counterclockwise as indicted by arrow 72. The conveyor auger 52 may be driven by a suitable drive means 74 such as a hydraulic or electric motor.

The inlet port 76 for the conveyor auger 52 is configured to receive the three phase mixture 14 through suitable piping in flow communication with the feed pump 24. In addition, the conveyor auger 52 includes a plurality of emulsion inlets 78 formed through an outside diameter thereof configured to discharge the three phase mixture 14 from its hollow interior portion 48 into the hollow interior portion 46 of the rotatable bowl 50. In the illustrative embodiment of the invention, the three phase mixture 14 is discharged into the rotatable bowl 50 with a flow direction towards the fluids discharge end 60 of the rotatable bowl 50. This is termed a co-current inlet flow. Alternately, the centrifuge 12 may be configured with a counter current inlet flow.

The conveyor auger 52 also includes helically wound flights 80 on its outer periphery. The helical flights 80 move the solid phase component 20 (solids) against the inside of the rotatable bowl 50 and through the solids discharge ports 56. The conveyor auger 52 can rotate at from one to twelve revolutions per minute with respect to the rotatable bowl 50. For example, if the rotatable bowl 50 is rotating at 1780 rpm, the conveyor auger 52 can rotate at this rate plus one to twelve rpm's more. This rate is termed herein as the "conveyor auger ratio" and in general is a number between one and twelve.

The centrifuge 12 also includes three oil baffle plates 82, 84, 86 attached to the conveyor auger 52 and configured to maintain the pools of the first liquid phase component 16 (oil) therebetween. A first baffle plate 82 is located generally perpendicular to the longitudinal axis 66 of the rotatable bowl 50 proximate to the inlet 66 to the conveyor auger 52. A second baffle plate 84 is located generally perpendicular to the longitudinal axis 66 of the rotatable bowl 50 proximate to a center portion thereof. A third baffle plate 86 is located generally perpendicular to the longitudinal axis 66 of the rotatable bowl 50 proximate to the fluids discharge end 60.

During operation of the centrifuge 12 the baffle plates 82, 84, 86 function to confine the pool of the first liquid phase component 16 (oil) so that the first liquid phase component 16 can be discharged through the discharge tube 62. In addition, the center baffle plate 84 can include at least one opening 88 to permit flow of the first liquid phase component 16 (oil) therethrough. Further, additional baffle plates 90 can be located generally parallel to the longitudinal axis 66 of the rotatable bowl 50 proximate to the inlets 78 through the conveyor auger 52. The baffle plates 90 prevent the three phase mixture 14 entering the interior portion 46 of the rotatable bowl 50 from disrupting the pools of the first liquid phase component 16 (oil).

Vapor Recovery Unit

Figure 1B:
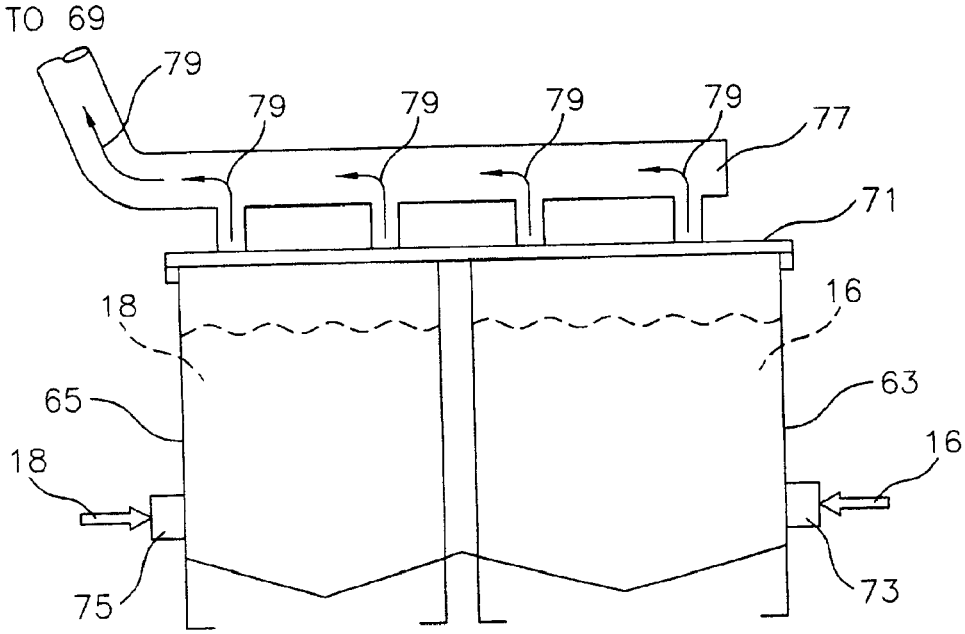
FIG. 1B is a schematic side elevation view of catch tanks for the centrifuge taken along line 1B—1B of FIG. 1.
Figure 1C:
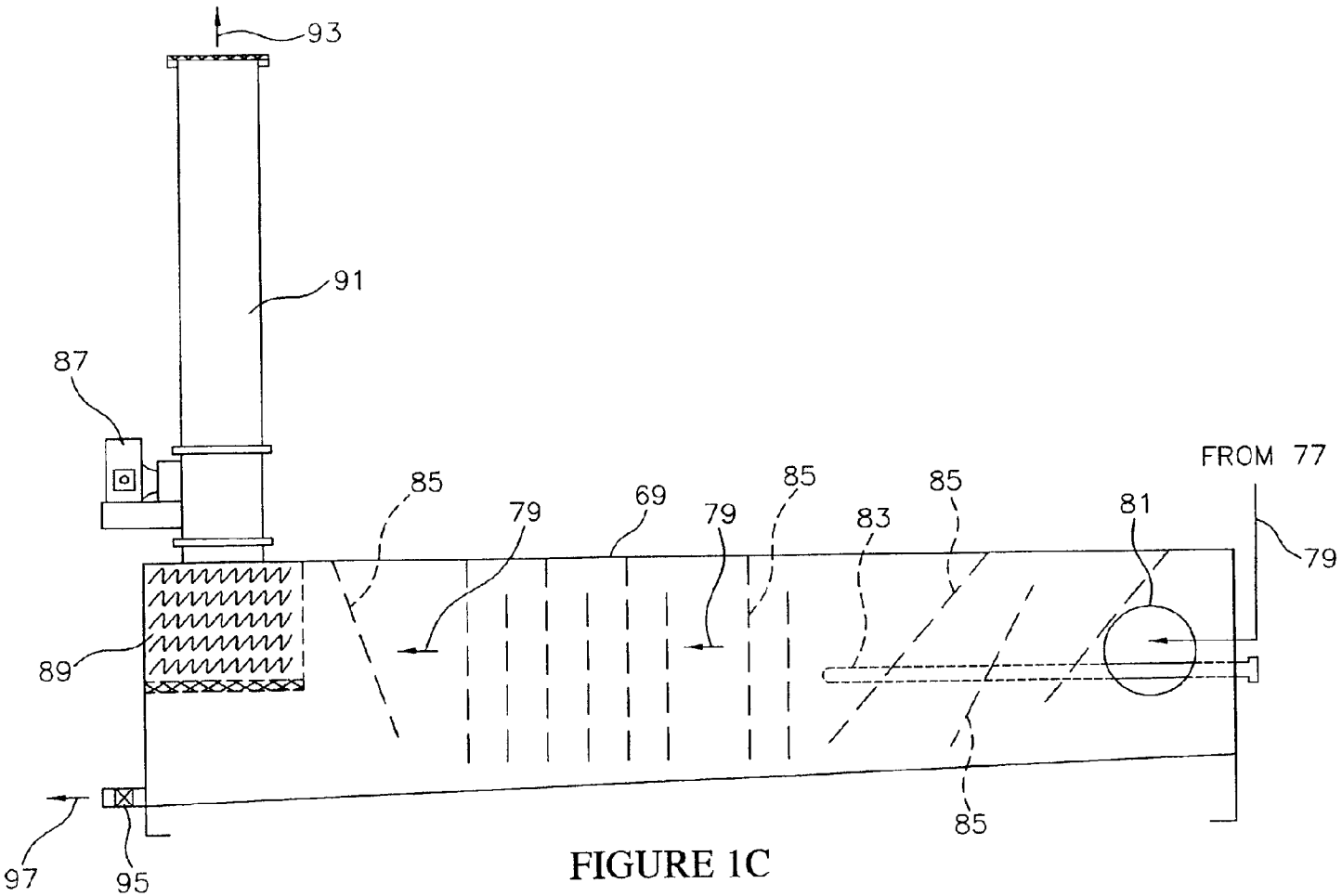
FIG. 1C is a schematic side elevation view of a vapor recovery unit of the centrifuge taken along line 1C—1C of FIG. 1.

Referring to FIGS. 1B and 1C, the catch tanks 63, 65 and vapor recovery unit 69 are illustrated. As shown in FIG. 1B, the catch tanks 63, 65 comprise sealed vessels having a removable cover 71. The first catch tank 63 (oil) includes an inlet 73 configured to receive the first liquid phase component 16 (oil). The second catch tank 65 (water) also includes an inlet 75 configured to receive the second liquid phase component 18 (water). In addition, the catch tanks 63, 65 include a manifold 77 in flow communication with the interiors of the catch tanks 63, 65 and with the vapor recovery unit 69. The manifold 77 is configured to receive vapor 79 from the catch tanks 63, 65 and to transfer the vapor 79 to the vapor recovery unit 69. The manifold 77 can be constructed of metal tubing, and is configured to receive the vapor which collects in the catch tanks 63, 65 in the space between the cover 71 and the liquid levels.

As shown in FIG. 1C, the vapor recovery unit 69 comprises a sealed vessel having an inlet 81 configured to receive the vapor 79 from the manifold 77 (FIG. 1B), and an exhaust stack 91 configured to exhaust hot air 93 to the atmosphere. The vapor recovery unit 69 also includes a fan 87 configured to move the vapor 79 from the manifold 77 (FIG. 1B) and through the vapor recovery unit 69. One suitable fan 87 is a belt driven tube axial fan manufactured by Dayton of Niles, Ill. and designated a model no. 4C659A.

The vapor recovery unit 69 also includes a drain valve 95 configured to discharge the liquefied vapor or condensate 97 into a collection vessel (not shown) such as an oil drum. The vapor recovery unit 69 also includes a plurality of baffles 83, 85 configured to collect and condense the vapor 79 into the condensate 97. The baffles 83, 85 can comprise metal plates configured to provide a large surface area for condensing the vapor 79 into the condensate 97. The baffles 83, 85 are also arranged in a pattern to permit the flow of the vapor 79 through the vapor recovery unit 69, while at the same time providing surfaces areas for contacting and condensing the vapor 79.

A first baffle 83 is oriented generally parallel to the flow of the vapor 79 (and to the ground), and is configured to intercept the vapor 79 as it enters the inlet 81 of the vapor recovery unit 69. The other baffles 85 are arranged at different angles to the flow of the vapor 79 with from 45° to 90° being preferred. The vapor recovery unit 69 also includes a mist arrestor 89, which can comprise screens, expanded metal, or a porous material such as intertwined metal strips similar to metal scrub pads for pots and pans. The mist arrestor 89 is configured to collect and condense the vapor 79 prior to exhausting of the hot air 93 from the exhaust stack 91.

Fuzzy Logic Control System

The fuzzy logic control system 22 performs both "feedback control" and "feed forward control". The term "feedback control" means that the performance of the centrifuge 12 is evaluated by measuring the quality of the first liquid phase component 16 (oil), and optionally the quality of the second liquid phase component 18 (water). Input variables are then generated based on these measurements. The output of the centrifuge 12 is then adjusted based on the input variables and a set of fuzzy logic rules, and adjustments are made to optimize the performance of the centrifuge 12.

The term "feed forward control" means the control system 22 anticipates future operation of the centrifuge based on input variables measured in the three phase mixture 14 (oil emulsion) prior to injection into the centrifuge 12. The output of the centrifuge 12 is then predicted based on the input variables and additional fuzzy logic rules, and adjustments are made to optimize the performance of the centrifuge 12.

In the illustrative embodiment the input variables for the "feedback control" are obtained by sensing the water and solids content of the first liquid phase component 16 (oil) which is termed herein the "Product Oil BS&W". The input variables for the feed forward control are obtained by sensing the cold feed temperature (T1), and the BS&W in the three phase mixture 14 (oil emulsion).

A first adjustment is the speed of the feed pump 24 which controls the feed rate of the three phase mixture 14 (oil emulsion). A second adjustment is the feed temperature set point (T2) of the three phase mixture 14 (oil emulsion). In this regard the fuzzy logic control system 22 sets the feed temperature set point (T2) and heater power is adjusted by the heater PID controller 27 to meet the set point requirements. These adjustments are made to optimize the quality of the first liquid phase component 16 (oil) which is termed in the rules to follow the "product oil".

Optionally, the control system 22 can be configured to also optimize the quality of the second liquid phase component 18 (water). The quality of the second liquid phase component 18 (water) is quantified by measuring its oil content, which is termed herein the "Product Water Oil Content". In the rules to follow, the "Product Water Oil Content" is considered and included in the software of the computer 100. However, the control system 22 only contains sensors for measuring the "Product Oil BS&W" such that "Product Water Oil Content" is not measured and utilized.

Feedback Control System

The feedback control system 31 includes a feedback controller 104, the PID controller 27 and the BS&W meter 33. Optionally, the feedback control system 31 can include the water quality meter 35. The feed back controller 104 is a program included in the computer 100 and programmed with a set of feedback control rules based on fuzzy logic.

The feedback control rules are of the form:

If the "Product Oil BS&W" is . . . and if the "Product Water Oil Content" is . . . Then the "Feed Rate Change" is and the "Feed Temperature Change" is . . .

Table 1 lists the rules.

TABLE 1

| Rule No. | If (Product Oil BS & W) is | and (Product Water Oil Content) is | Then (Feed Rate Change) is | and (Feed Temperature Change) is |
|---|---|---|---|---|
| 1 | Very High | High | Negative Big | Positive Big |
| 2 | Very High | OK | Negative Big | Positive Big |
| 3 | High | High | Negative Big | Positive Big |
| 4 | High | OK | Negative Small | Positive Small |
| 5 | OK | High | Negative Small | Positive Small |
| 6 | OK | OK | Zero | Zero |
| 7 | Low | High | Zero | Zero |
| 8 | Low | OK | Positive Small | Negative Small |

Figure 2A:
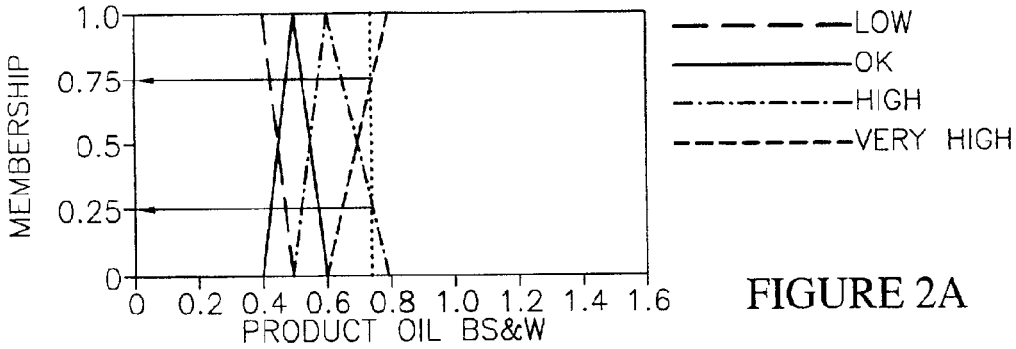
FIG. 2A is a chart illustrating input membership functions for product oil BS&W, only the triangles represent the membership functions, the vertical dotted lines and the arrows are associated with Examples 1 and 2.
Figure 2B:
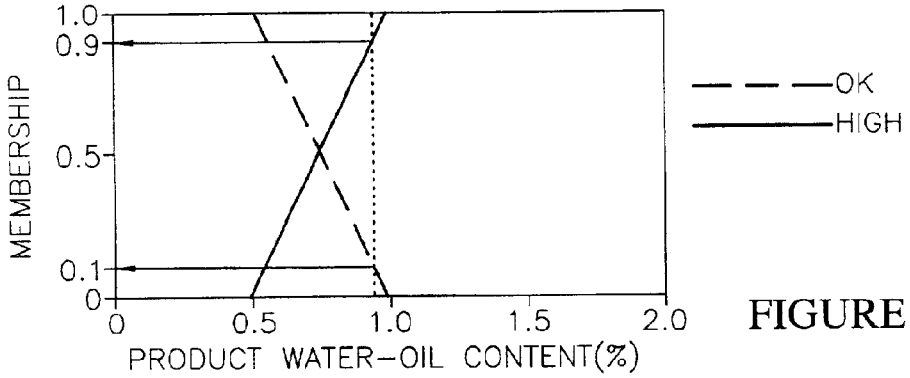
FIG. 2B is a chart illustrating input membership functions for product water-oil content, only the triangles represent the membership functions, the vertical dotted lines and the arrows are associated with Example 1.
Figure 3A:
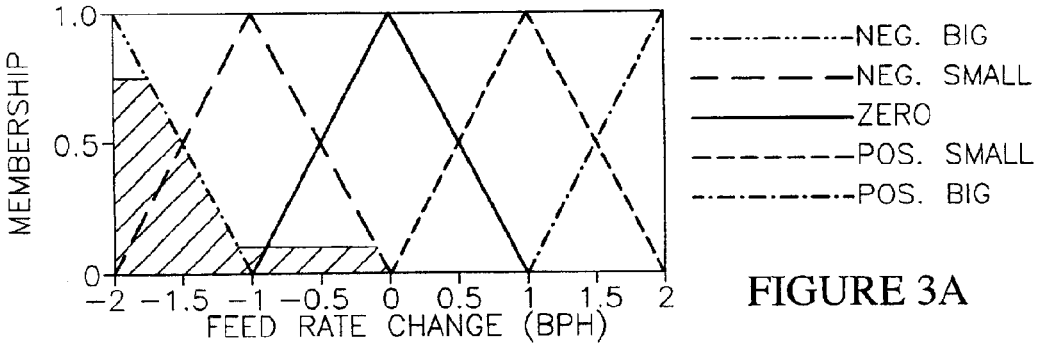
FIG. 3A is a chart illustrating output membership functions for feed rate change, the cross hatched regions represent clipped membership functions associated with Example 1.
Figure 3B:
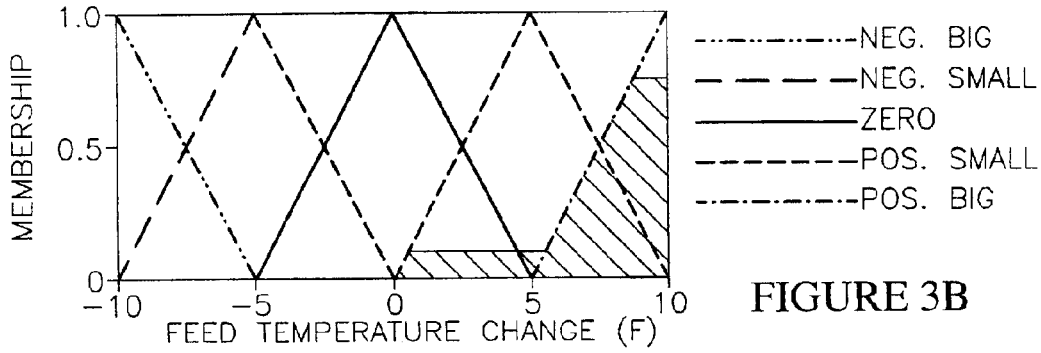
FIG. 3B is a chart illustrating output membership functions for feed temperature change, the cross hatched regions represent clipped membership functions associated with Example 1.

The input membership functions are shown FIGS. 2A and 2B. The output membership functions are shown in FIGS. 3A and 3B.

EXAMPLE 1

Suppose that the BS&W meter 33 (FIG. 1) for the first liquid phase component 16 (oil) produced by the centrifuge 12, and the water quality meter 35 (FIG. 1) for the second liquid phase component 18 (water) produced by the centrifuge 12 measure the following values: product oil BS&W= 0.75% and the percent oil in the product water=0.95%. FIGS. 2A and 2B are used to determine the input membership values obtained with these readings. In this example the BS&W reading of 0.75% has a membership of 0.25 in High and 0.75 in Very High. The percent oil in the product water of 0.95% has a membership of 0.10 in OK and 0.90 in High. FIGS. 3A and 3B can be used to determine the output membership functions where the shaded areas represent the clipped output membership functions.

In this example four of the eight rules in Table 1 are fired. The rules that have input variables with a membership of greater than zero are fired. These rules are one through four. Since four rules were fired, they must be combined in a logical fuzzy manner. The resolution rule used here was the min-max rule. In our example, the product oil BS&W has a membership of 0.75 in the fuzzy set, or membership function, Very High. It also has a membership of 0.25 in the set High. The oil in the product water has a membership of 0.90 in the set High and 0.10 in the set OK. All of the rules have two associated input membership values. The membership values for rule one are 0.75 for Very High BS&W in the product oil and 0.90 for High oil content in the product water. The minimum portion of the min-max rule causes this rule to be fired with the minimum value of 0.75. In a similar manner rule two is associated with the membership values of 0.75 and 0.10. It is fired with the minimum strength of 0.10. Rule three is associated with membership values of 0.25 and 0.90. It is fired with a minimum strength of 0.25. Rule four is associated with membership values of 0.25 and 0.10. It is fired with the minimum value of 0.10. The maximum portion of the min-max rule is used to determine the combination rule output or antecedent. Rules one through three have an antecedent of "Negative Big" for "Feed Rate Change and Positive Big for Feed Temperature Change". The strengths of these rules are 0.75, 0.10 and 0.25 respectively, as determined by the minimum portion of the min-max rule. The maximum value of 0.75 is used for the final value or strength of the combination of these three rules. The result is that the output membership function that describes the change in feed rate as "Negative Big", is truncated at the value of 0.75 as shown with the cross hatched portion of the leftmost triangle in FIG. 3A. The same rule provides that the output membership function that describes the change in feed temperature as "Negative Big", is truncated at the value of 0.75 as shown with the cross hatched portion in the rightmost triangle in FIG. 3B. Rule four is the only rule that suggests that the feed rate change should be "Negative Small" and the feed temperature change should be "Positive Small". It is fired with the strength of 0.10 as determined by minimum portion of the min-max rule. No maximum portion of the min-max rule is needed here since this is the only fired rule that has this antecedent. As shown in the FIGS. 3A and 3B, the membership functions that represent the change in feed rate of "Negative Small" and the change in feed temperature of "Positive Small" are truncated at a value of 0.10. The combination of the output of rules one through four is shown as the truncated membership functions in FIGS. 3A and 3B. The output values that are actually used are the centroids of these truncated figures. In this case about minus 1.457 barrels per hour (BPH) for the feed rate change and approximately plus 7.283° F. for the feed temperature change. The centroid values obtained from this calculation are converted to voltage signals and sent to the variable drive mechanism 44 for the feed pump 24, and to the heater 26 to reduce the feed rate and increase the feed temperature accordingly.

There are several different techniques that are available for defuzzification. Since fuzzy logic is quite flexible, we have used the technique most appropriate for the problem we were addressing or most appropriate for the software we were working with, or simply the most convenient technique. Here, we have used the centroid of the truncated membership functions exactly as they appear in the figures. The centroid, or defuzzzified, value is given by equation.

(1).

$$\text{centroid} = \frac{\int f(x)x\,dx}{\int f(x)\,dx}$$

where f(x) is the function that describes the clipped membership function.

In this case it would be the function that describes the perimeter of the cross hatched areas in FIGS. 3A and 3B.

By examining the output membership shown in FIGS. 3A and 3B, it is noted that it is not possible to obtain the end-point values of +2 barrels per hour for the feed rate change of ±10° F. feed temperature change using the centroid technique. We can never get centroids of +2 or +10. In this example it doesn't matter. This was taken into account when building the membership functions.

EXAMPLE 2

In this example only the BS&W of the first liquid phase component 16 (oil) is considered. The control rules for this example are given in Table 2.

TABLE 2

Fuzzy rules for the feedback control system 31 without Oil in Product Water as an input variable

| Rule No. | If (Product Oil BS & W) is | Then (Feed Rate Change) is | and (Feed Temperature Change) is |
|---|---|---|---|
| 1 | Very High | Negative Big | Positive Big |
| 2 | High | Negative Small | Positive Small |
| 3 | OK | Zero | Zero |
| 4 | Low | Positive Small | Negative Small |

Figure 4A:
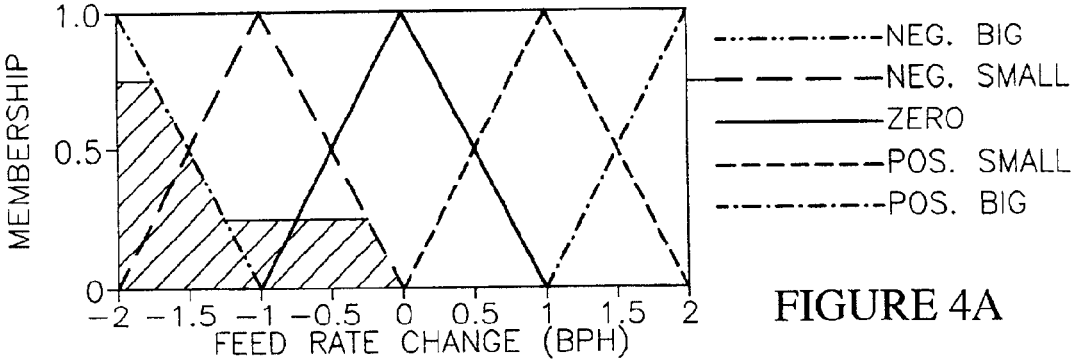
FIG. 4A is a chart illustrating the clipped output membership functions from Example 2 for the feed rate change in barrels per hour using the rules in Table 2.
Figure 4B:
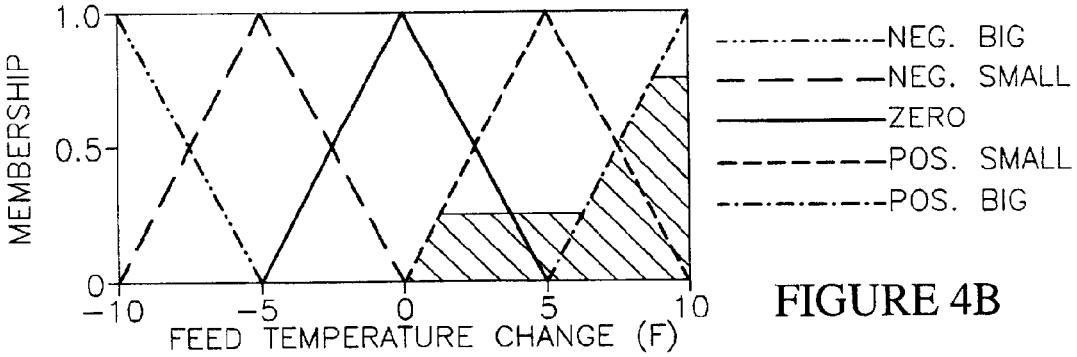
FIG. 4B is a chart illustrating the clipped output membership functions from Example 2 for the feed temperature change in ° F. using the rules in Table 2.

With the same product oil BS&W as in Example 1 (0.75%), rules 1 and 2 in Table 2 are fired with strengths of 0.75 and 0.25 respectively. The clipped output membership functions for this example are shown in FIGS. 4A and 4B. The centroids for these two figures are −1.293 and 6.524 respectively. The defuzzified control outputs are a "Feed Rate Change" of −1.293 BPH and a "Feed Temperature Change" of 6.524° F. These values are slightly different than the values of −1.457 BPH and 7.283° F. obtained in Example 1.

Figure 5:
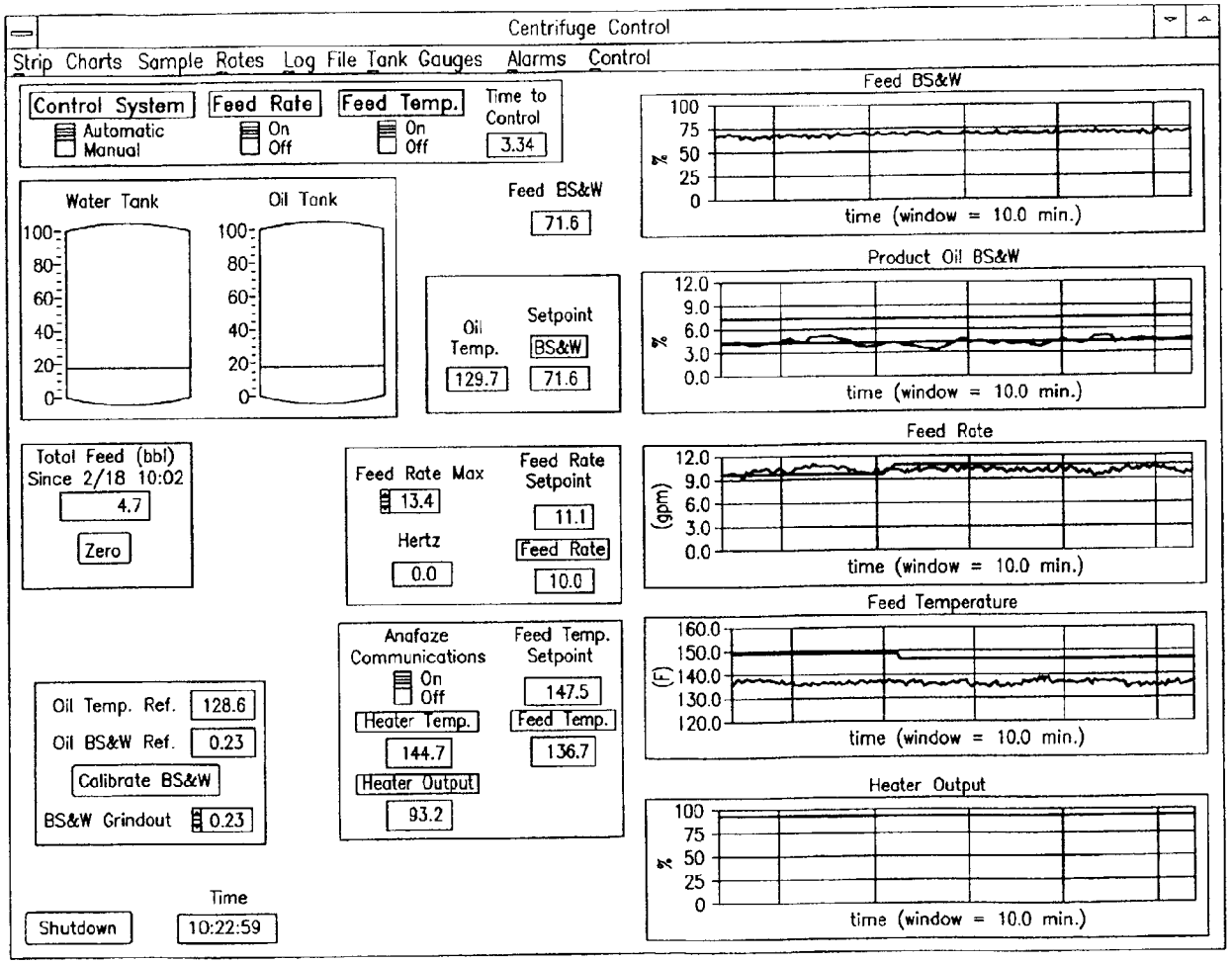
FIG. 5 is a view of a control screen for the fuzzy logic control system.

FIG. 5 illustrates a computer control screen 102 for the computer 100 of the fuzzy logic control system 22. The screen, gives an operator instant access to all pertinent information. The current catch tank levels for the first liquid phase component 14 (oil) and the second liquid phase component 18 (water) are shown graphically. Important input and output variables are shown both with their current values in a digital format and an analog display as a strip chart showing their time history.

Figure 4C:
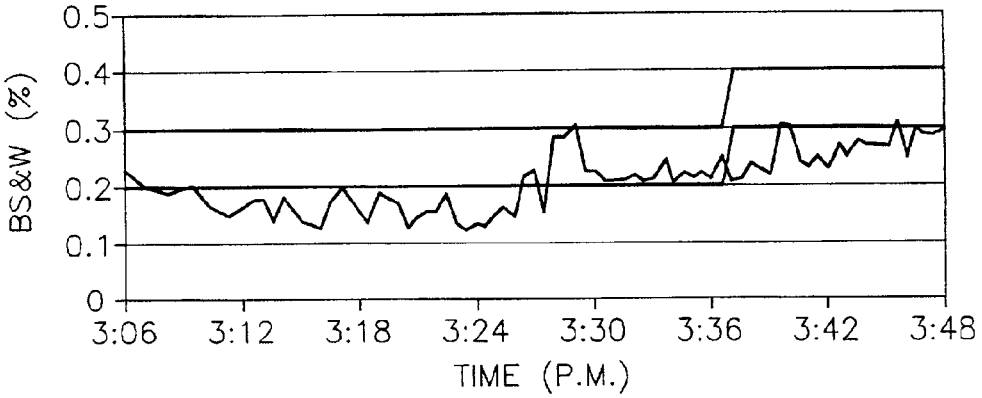
FIG. 4C is a chart illustrating the product oil BS&W as a function of time from an actual run using the rules in Table 2.

FIG. 4C illustrates an actual output from a run using the rules in Table 2. In FIG. 4C the variable under control, the product oil BS&W, is represented as a function of time.

Feed Forward Control System

As shown in FIG. 1A, the feed forward control system 36 includes a feed forward controller 37, a fuzzy soft sensor 38, and a fuzzy SPC filter 34 configured to filter out sensor noise. The feed forward controller 37 processes large changes in the feed of the three phase mixture 14 (oil emulsion) that require process control adjustments before problems are encountered in the centrifuge 12. The fuzzy soft sensor 38 includes and applies the fuzzy logic rules. The fuzzy SPC filter 34 differentiates between noise in the measured feed variables and a true change in the control variables (pump speed, heater power requirements). Accordingly, changes in the control variables are not made unless they are truly required. The fuzzy-SPC filter 34 filters out the sensor noise based on individual and moving range charts to be hereinafter described.

Figure 6A:
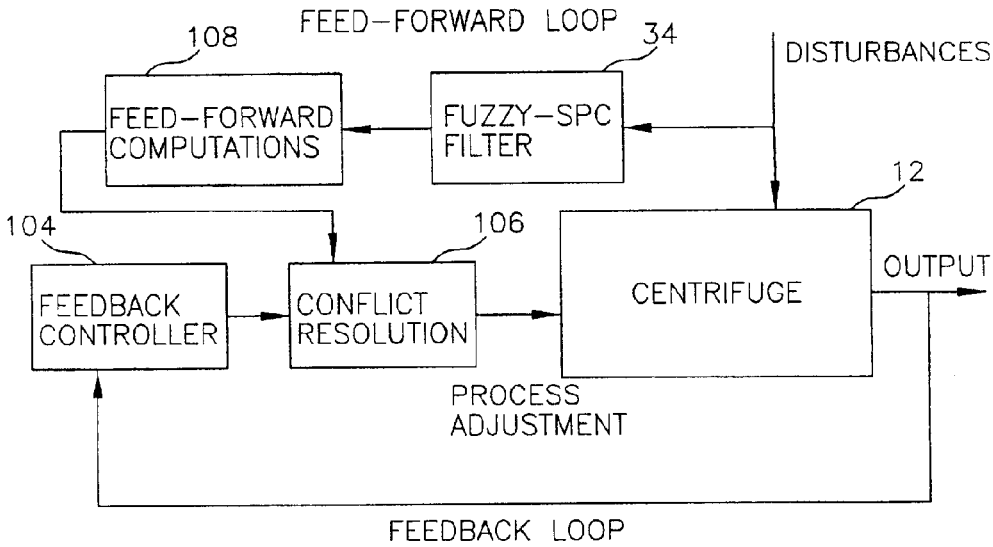
FIG. 6A is a flow diagram illustrating operation of a feed forward loon and feedback loop for the fuzzy feed forward control system.
Figure 6B:
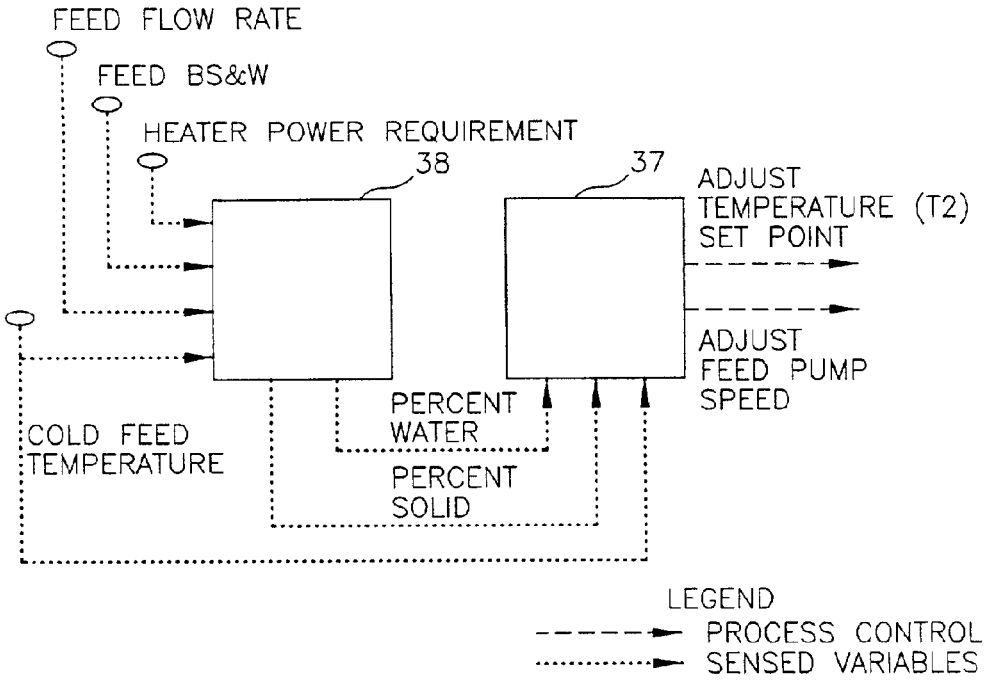
FIG. 6B is a flow diagram illustrating the operation of a fuzzy feed forward control system and fuzzy soft sensor of the fuzzy logic control system.

Referring to FIG. 6A, the interaction of the feed forward loop for the feed forward control system 36, and the feed back loop for the feedback control system 31 is illustrated in a block diagram. The feedback controller 104 is continually working, making adjustments to the feed rate and the feed temperature set point (T2). A conflict resolution portion 106 of the feedback controller 104 insures that corrections to the process due to both feedback and feed forward conditions are compatible with the goals of the feedback controller 104 and the feed forward controller 37 (FIG. 6B). Feed forward events dominate because they are future events, and only significant events are acknowledged because of the fuzzy-SPC filter 34. However, some weight is given to current events governed by the feedback controller 104.

The feed forward computations 108 include computations from the fuzzy soft sensor 38 and from the feed forward controller 37. This combination of computations is shown in FIG. 6B. These computations require three input variables to determine what adjustments, if any, are required for the feed pump 24 and the feed temperature set point (T2). These variables are the cold feed temperature (T1), the percent change of water in the three phase mixture 14 (emulsion) and percent change of solid in the three phase mixture 14 (emulsion). Although the percentage change of water and solid is not measured directly, the change of BS&W in the three phase mixture 14 (emulsion) is the sum of the water and solid change. In addition, the change in power requirements for the heater 26 for maintaining a given set point temperature (T2) and the volumetric flow rate are measured. Based on these measurements, the feed BS&W measurements, and the cold feed temperature (T1) changes, we can determine the corresponding changes in the feed water and solid content. This is because of the knowledge programmed into the fuzzy soft sensor 38 in the form of fuzzy rules and membership functions.

Fuzzy-SPC Filter 34

Figure 7A:
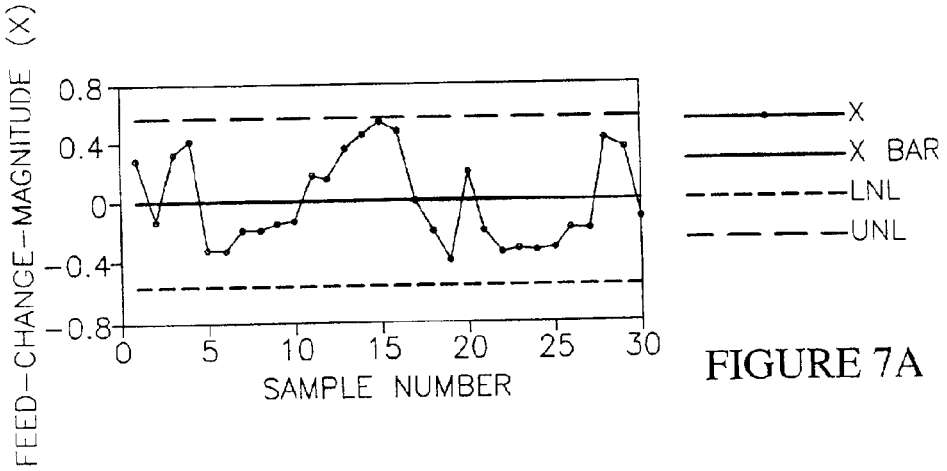
FIG. 7A is a chart illustrating feed magnitude change for the a fuzzy SPC filter of the fuzzy logic control system.

The fuzzy-SPC filter 34 is designed to prevent the feed forward controller 37 from acting upon feed changes that are really just noise in the sensors and the system. The fuzzy-SPC filter 34 is in the form of a program programmed into the computer 100. The fuzzy-SPC filter 34 is an implementation of a fuzzy version of the statistical process control (SPC) charts known as Individual and Moving Range charts. FIG. 7A is a Individual Chart and FIG. 7B is a Moving Range chart.

Figure 7B:
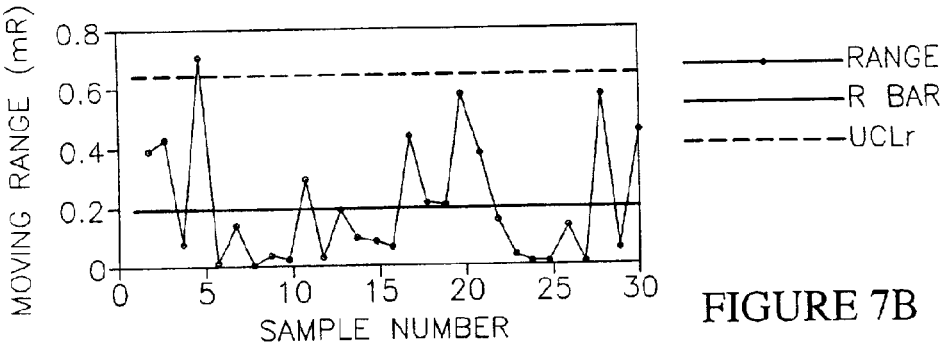
FIG. 7B is a chart illustrating moving chart range for the fuzzy SPC filter of the fuzzy logic control system.

FIGS. 7A and 7B were patterned after more commonly used X bar-R charts. These particular figures were developed using a computer model and a random number generator. In addition, we ordered the numbers produced by the random number generator in an attempt to simulate auto-correlated values. In the Chemical Process Industries, almost all samples taken from a continuous process are auto-correlated. This means the current sample is dependent upon the previous sample. Auto correlation raises some questions about theoretical concepts such as independence but the SPC version of this technique works quite well.

In the system 10 we have modified the SPC technique to include fuzzy logic. The reason for the modification is that the expert operator normally looks for indications that the feed BS&W has changed by a magnitude of at least +10% before implementing a manual feed-forward control. The fuzzy logic control system 22 can measure this with the feed BS&W meter 32. However, this is not the whole story. The concentration of water and solids in the three phase mixture 14 (oil emulsion) can change in opposite directions, making the BS&W reading lower than +10%. The feed-forward controller 37 relies on knowledge of the water and solid changes individually, not the total BS&W change. The fuzzy soft-sensor 38 determines the magnitude of the individual water and solids changes from knowledge about feed pump flow changes and feed heater power requirement changes, in addition to the total feed BS&W change. The fuzzy-SPC filter 34 incorporates these three variables into a single variable that we call Feed-Magnitude-Change, and that is the value used with the SPC technique rather than just the feed BS&W change. In the system 10, these changes can be developed in the field each workday at the beginning of the run after steady-state operation is achieved.

Figure 8A:
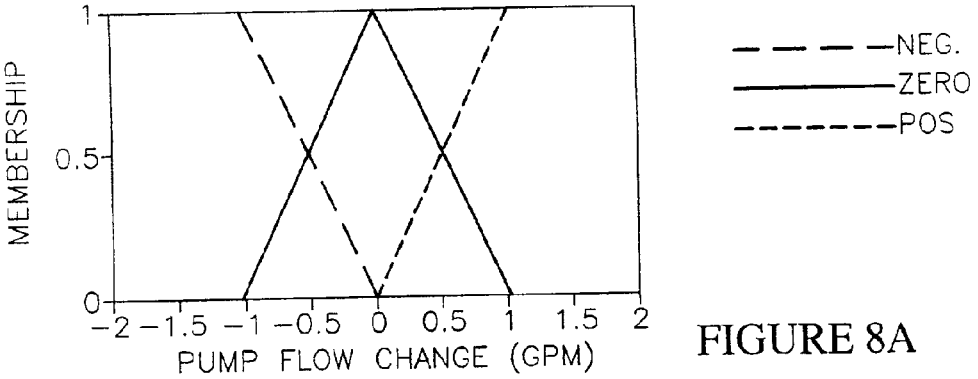
FIG. 8A is a chart illustrating input membership functions for the variable pump flow change (gpm) for the fuzzy SPC filter.
Figure 8B:
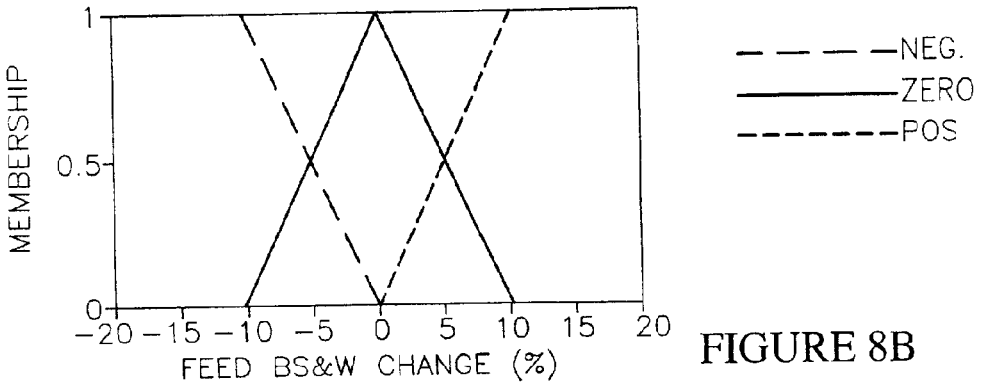
FIG. 8B is a chart illustrating input membership functions for the feed BS&W change (%) for the fuzzy SPC filter.
Figure 8C:
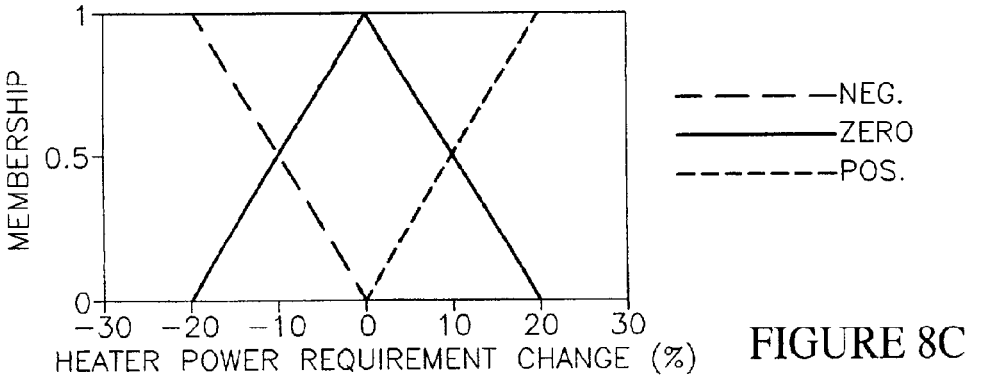
FIG. 8C is a chart illustrating input membership functions for the variable heater power requirement change for the fuzzy SPC filter.
Figure 9:
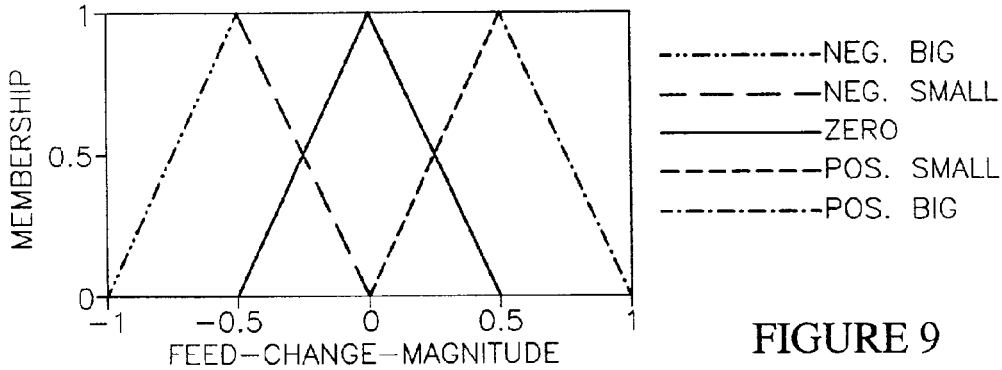
FIG. 9 is a chart illustrating output membership functions for the variable feed change magnitude for the fuzzy SPC filter.

The Individual chart of FIG. 7A, and the Moving Range chart of FIG. 7B are constructed in the following manner:

- Data sets, comprising feed pump flow, heater power requirements, and feed BS&W, are taken at a specified sample interval (depending upon the current centrifuge operation-currently from about 10 seconds to about a minute). If a temperature change occurs the sample is corrected for temperature as will be more fully described.
- The differences in each succeeding set for the three variables are computed. These differences are called Variable Changes e.g., Feed BS&W Change.
- The Variable Changes are used with the rules in Table 3, the input membership functions in FIGS. 8A, 8B and 8C, and the output membership functions in FIG. 9, in the previously described manner to produce a variable call Feed-Change-Magnitude. This is the Individual variable that is plotted in FIG. 7A.
- At each step, the difference between the current Feed-Change-Magnitude and the previous Feed-Change-Magnitude is computed. This is the Moving Range Value plotted in FIG. 7B.
- After thirty sets (five minutes to half an hour), the Individual and the Moving Range averages are computed.
- The upper and lower control limits for the Individual charge (sometimes called the upper and lower natural limits, designated LNL and UNL, respectively in the FIG. 7A), are computed from equations 2 and 3. The upper control limit for the Moving Range Chart (designated UCLr in FIG. 7B) is computed from equation 4. These control limits are essentially three standard deviations above and below the mean or average lines.
- If the Individual values stray beyond the control limits, the "Feed-Change-Magnitude" is assumed to be significant and the fuzzy soft-sensor 38 and feed-forward controller 37 are implemented.
- If the Moving Range data go beyond the control limits, it usually means a rapid short-term change or that sensor difficulties are coming into play. The Moving Range chart (FIG. 7B) is available to the operator, but currently no automatic control action is implemented based on Moving Range data.

$$UNL=\bar{X}+2.660\ \overline{\mathrm{mR}} \quad (2)$$

$$LNL=\bar{X}-2.660\ \overline{\mathrm{mR}} \quad (3)$$

$$UCLr=3.268\ \overline{\mathrm{mR}} \quad (4)$$

The terms UNL, LNL and UCLr are abbreviations for upper natural control limit, lower natural control limit, and upper control limit for the Moving Range, respectively. The symbol (X) is the Individual average (for thirty samples in this case), designated as Xbar in FIG. 7A. The symbol (mR) is the Moving Range average, designated as Rbar in FIG. 7B.

FIG. 7A shows that the feed composition generated by the computer model does not stray beyond the control limits. This means that the fuzzy soft-sensor 36 and the feed-forward controller 37 would not be activated by any of the information generated by the computer model by this chart. However, the long-term trend indicated by point 12 through 16 might indicate that at that time the system was moving "out of control" and control action might soon be required. In FIG. 7B, the Moving Range chart, the point generated from sample number five is beyond the upper control limit. This comes from a rapid but small reverse in sign for the change in the feed BS&W. With actual data this could be an early warning of an impending feed composition change.

The "Feed-Change-Magnitude" is computed with a fuzzy rule based system. If we look at FIG. 6B, we see that four input variables are used in the soft-sensor to compute two output variables, percent change in water, and percent change in solid. All four of those variables, cold feed temperature, feed flow rate, feed BS&W, and feed heater requirements, have associated random noise and are not independent. It is rather easy to correct for the cold feed temperature change. If necessary, the temperature correction is made and then the other three variables "Feed Flow Rate Change", "Feed BS&W Change", and "Feed Heater Requirement Change" are used with the fuzzy rule base to computer the "Feed-Magnitude-Change". As shown in Table 3, there are twenty-seven rules, three input variables, nine input membership functions, one output variable and five output membership functions in our fuzzy system. The rules are of the form:

If the "Feed Flow Rate Change" is . . . and the "Feed BS&W Change" is . . . and the "Feed Heater Requirement Change" is . . .

Then the "Feed-Change-Magnitude" is . . .

All of the input membership functions are ternary —"Positive", "Zero", and "Negative Changes". The output has five membership functions "Large Positive", "Small Positive", "Zero", "Small Negative", and "Large Negative". These membership functions are normalized between −1 and 1.

Other techniques are available for filtering the input and sensor noise. However, we feel the present technique is the best. It provides us with a technique for withholding a significant process change unless it is really needed. It provides us with a means to determine if the process feed is changing significantly. If the changes are slow enough they can be handled with the feedback system entirely. More abrupt changes will require the feed-forward system intervention. We can also determine changes in sensor noise and can determine in advance if we are having sensor problems. Note that once the initial control chart has been constructed (reasonably early into the run), we can sample and control as much as we want. The control charts are continually upgraded. The control chart upgrade goes on in the background.

The rules for the fuzzy-SPC filter are given in Table 3. The input membership functions are given in FIGS. 8A–8C and the output membership functions are given in FIG. 9.

TABLE 3

Rules for the fuzzy-SPC filter.

| Rule Number | If (Feed Flow Rate Change) is | and (Feed BS & W Change) is | and (Feed Heater Requirement Change) is | Then (Feed-Change-Magnitude is |
|---|---|---|---|---|
| 1 | Negative | Negative | Negative | Large Negative |
| 2 | Negative | Negative | Zero | Large Negative |
| 3 | Negative | Negative | Positive | Small Negative |

TABLE 3-continued

Rules for the fuzzy-SPC filter.

| Rule Number | If (Feed Flow Rate Change) is | and (Feed BS & W Change) is | and (Feed Heater Requirement Change) is | Then (Feed-Change-Magnitude is |
|---|---|---|---|---|
| 4 | Negative | Zero | Negative | Large Negative |
| 5 | Negative | Zero | Zero | Zero |
| 6 | Negative | Zero | Positive | Zero |
| 7 | Negative | Positive | Negative | Large Positive |
| 8 | Negative | Positive | Zero | Large Positive |
| 9 | Negative | Positive | Positive | Small Positive |
| 10 | Zero | Negative | Negative | Large Negative |
| 11 | Zero | Negative | Zero | Small Negative |
| 12 | Zero | Negative | Positive | Large Negative |
| 13 | Zero | Zero | Negative | Small Negative |
| 14 | Zero | Zero | Zero | Zero |
| 15 | Zero | Zero | Positive | Small Positive |
| 16 | Zero | Positive | Negative | Small Positive |
| 17 | Zero | Positive | Zero | Small Positive |
| 18 | Zero | Positive | Positive | Large Positive |
| 19 | Positive | Negative | Negative | Large Negative |
| 20 | Positive | Negative | Zero | Large Negative |
| 21 | Positive | Negative | Positive | Large Negative |
| 22 | Positive | Zero | Negative | Small Positive |
| 23 | Positive | Zero | Zero | Small Positive |
| 24 | Positive | Zero | Positive | Large Positive |
| 25 | Positive | Positive | Negative | Small Positive |
| 26 | Positive | Positive | Zero | Large Positive |
| 27 | Positive | Positive | Positive | Large Positive |

The upper and lower natural control limits shown in FIG. 7A are 0.5449 and 0.5692, respectively. Currently, we are using these values as the controls limits or the bounds for a go or no-go decision on making a feed-forward control adjustment. We can use any value we want for the actual control limit, but unless we want too many "false alarms" the control limits should either be these limits or values outside of these limits. This system will need more turning once it is implemented in the field. But it works quite well with computer-generated numbers. The values in Table 4 represent some of the numbers generated by the simulation code in order to develop the rules and membership functions for the fuzzy soft-sensor. These numbers were randomly picked from the set of all numbers used. We can see from the last column in Table 4, Feed-Change-Magnitude, that all of these passed through the fuzzy-SPC filter as intended. All of the numbers in the last column are either greater than 0.5449 or less than −0.5692. Sample numbers six, eleven, and fourteen would not have passed the normal SPC filter test with our criterion of +10% change for the feed BS&W. The feed-forward controller 37 should act upon these samples since the individual feed water concentration and feed solid concentration varied significantly. The expert operator would normally detect these changes by noticing changes in the other process variables. In the manual mode he would probably make changes without thinking much about what he had observed. The automatic system that we have developed has to work with very carefully spelled out directions in order to make the same changes that the expert operator would.

TABLE 4

Simulated feed conditions and operating parameters with the computer Feed-Change-Magnitude that allowed passage through the fuzzy-SPG filter.

| Sample Number | Flow Rate Change (gpm) | Feed BS & W Change (%) (%) | Heater Power Requirement Change | Percent Water Change | Percent Solid Change | Feed-Change-Magnitude |
|---|---|---|---|---|---|---|
| 1 | −0.9868 | −15.0 | −24.9072 | −10.0 | −5.0 | −1 |
| 2 | −0.9858 | −10.0 | −25.5324 | −10.0 | 0.0 | −1 |
| 3 | −2.5944 | −10.0 | −60.7935 | −15.0 | 5.0 | −1 |
| 4 | −0.5730 | −10.0 | −7.3806 | 0.0 | −10.0 | −0.7793 |
| 5 | 0.0909 | 10.0 | 0.0142 | 0.0 | 10.0 | 0.5611 |
| 6 | 1.1961 | 0.0 | 30.0429 | 10.0 | −10.0 | 1 |
| 7 | 1.8378 | 10.0 | 42.6106 | 10.0 | 0.0 | 1 |
| 8 | 2.5513 | 20.0 | 58.5209 | 15.0 | 5.0 | 1 |
| 9 | −1.3904 | −15.0 | −30.6755 | −10.0 | −5.0 | −1 |
| 10 | −2.3235 | −15.0 | −52.3410 | −15.0 | 0.0 | −1 |
| 11 | −1.3890 | 0.0 | −35.9500 | −10.0 | 10 | −1.0 |
| 12 | 0.8432 | −10.0 | 14.2684 | 0.0 | −10.0 | −0.8963 |
| 13 | −0.1294 | 10.0 | −3.0514 | 0.0 | 10.0 | 0.5840 |
| 14 | 1.5198 | 5.0 | 33.7269 | 10.0 | −5.0 | 1 |
| 15 | 1.7525 | 10.0 | 36.9448 | 10.0 | 0.0 | 1 |
| 16 | 0.9093 | 20.0 | 22.6764 | 10.0 | 10.0 | 1 |
| 17 | −0.9084 | −15.0 | −23.7192 | −10.0 | −5.0 | −1 |
| 18 | 1.2395 | 22.0 | 27.8453 | 10.0 | 12.0 | 1 |
| 19 | 0.7852 | 17.0 | 9.6989 | 0.0 | 17.0 | 0.8473 |
| 20 | −0.2810 | 17.0 | −12.1615 | −5.0 | 22.0 | 0.6694 |

Fuzzy Feed Forward Controller 37

The fuzzy feed-forward controller 37 is designed for disturbance rejection. The disturbances come in the form of feed disturbances. The feed disturbances that cause problems are cold feed temperature changes, that is, changes in the temperature of the three phase mixture 14 (oil emulsion) before it reaches the feed heater 26, which cause changes in feed heater power requirements. The other disturbances that cause problems are changes in the feed BS&W. Knowledge of the change in the feed BS&W alone is not helpful. The variables that are meaningful are the changes in the percent water in the feed and changes in the percent solid in the feed. The sum of these two changes is equal to the change in the feed BS&W, which is the variable that we can measure. The fuzzy soft-sensor 36 uses the variables that we an measure, cold feed temperature, feed BS&W feed flow rate change, and feed heater requirements to predict the changes in the feed water and solid content. FIG. 6B illustrates the combination of the feed-forward controller and the fuzzy soft sensor.

There are 27 rules, three input variables, nine input membership functions, two output variables, and six output membership functions. The rules are of the form: if "Feed Water Composition Change" is . . . and "Feed Solid Composition Change" is . . . and "Cold Feed Temperature Change" is. Then "Feed Pump Speed Change" is . . . and "Feed Heater Setpoint Change" is . . .

Figure 10A:
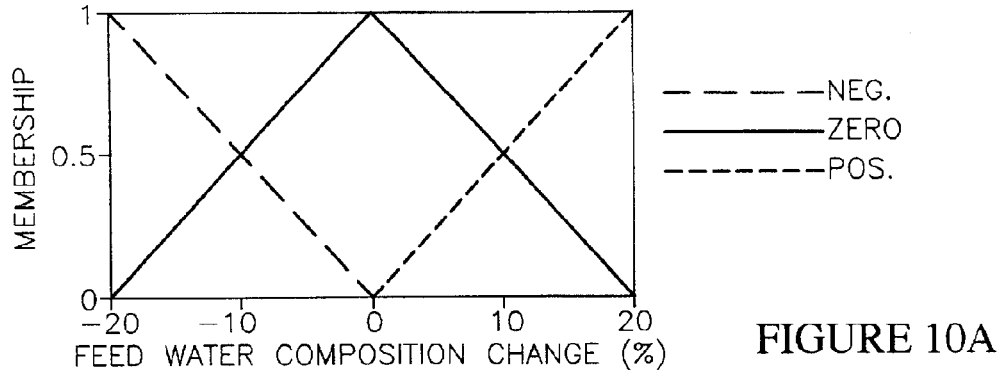
FIG. 10A is a chart illustrating input membership functions for feed water composition change (%)
Figure 10B:
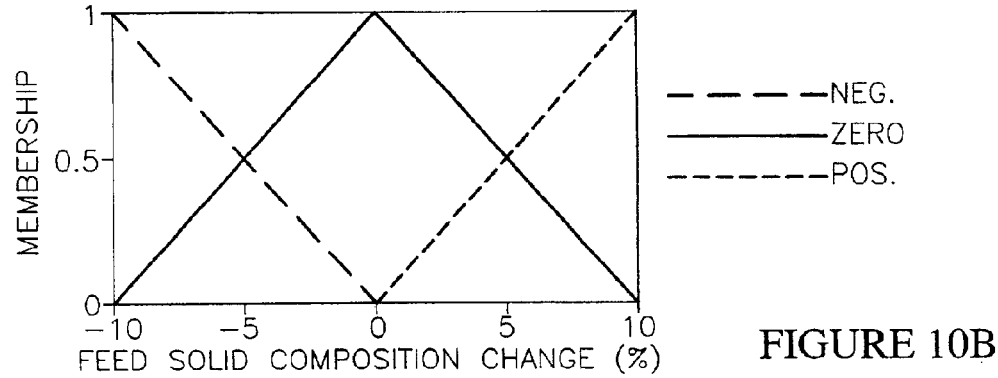
FIG. 10B is a chart illustrating input membership functions for feed solid composition change.
Figure 10C:
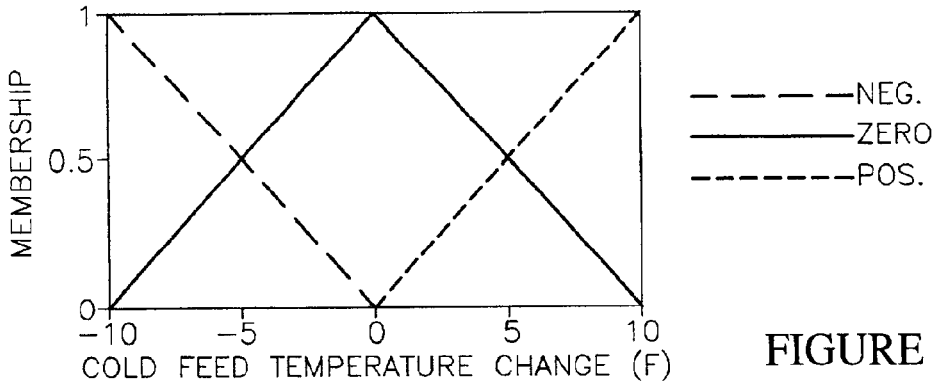
FIG. 10C is a chart illustrating input membership functions for cold feed temperature change (° F.)

The feed-forward control rules are given in Table 5. The input membership functions are given in FIG. 10A, FIG. 10B and FIG. 10C, and the output membership functions are given in FIG. 11A and FIG. 11B.

TABLE 5

The fuzzy rules for the feed-forward control system 36

| Rule No. | if (Feed Water Composition Change) is | and (Feed Solid Compo-sition Change) is | and (Cold Feed Temp. Change) is | Then (Feed Pump Speed Change) is | and (Feed Heater Change) is |
|---|---|---|---|---|---|
| 1 | Negative | Negative | Negative | Zero | Positive |
| 2 | Negative | Negative | Zero | Zero | Zero |
| 3 | Negative | Negative | Positive | Zero | Negative |
| 4 | Negative | Zero | Negative | Zero | Positive |
| 5 | Negative | Zero | Zero | Zero | Zero |
| 6 | Negative | Zero | Positive | Zero | Negative |
| 7 | Negative | Positive | Negative | Positive | Zero |
| 8 | Negative | Positive | Zero | Positive | Zero |
| 9 | Negative | Positive | Positive | Positive | Negative |

TABLE 5-continued

The fuzzy rules for the feed-forward control system 36

| Rule No. | if (Feed Water Composition Change) is | and (Feed Solid Compo-sition Change) is | and (Cold Feed Temp. Change) is | Then (Feed Pump Speed Change) is | and (Feed Heater Change) is |
|---|---|---|---|---|---|
| 10 | Zero | Negative | Negative | Zero | Positive |
| 11 | Zero | Negative | Zero | Zero | Zero |
| 12 | Zero | Negative | Positive | Positive | Negative |
| 13 | Zero | Zero | Negative | Zero | Positive |
| 14 | Zero | Zero | Zero | Zero | Zero |
| 15 | Zero | Zero | Positive | Zero | Negative |
| 16 | Zero | Positive | Negative | Zero | Positive |
| 17 | Zero | Positive | Zero | Zero | Zero |
| 18 | Zero | Positive | Positive | Zero | Zero |
| 19 | Positive | Negative | Negative | Zero | Positive |
| 20 | Positive | Negative | Zero | Zero | Zero |
| 21 | Positive | Negative | Positive | Positive | Zero |
| 22 | Positive | Zero | Negative | Zero | Positive |
| 23 | Positive | Zero | Zero | Zero | Zero |
| 24 | Positive | Zero | Positive | Negative | Negative |
| 25 | Positive | Positive | Negative | Zero | Positive |
| 26 | Pasitive | Positive | Zero | Zero | Zero |
| 27 | Positive | Positive | Positive | Zero | Zero |

EXAMPLE 3

When the sun goes down in the oil field, especially in the winter, temperatures often drop suddenly. This can cause the properties of the three phase mixture 14 (oil emulsion) to change, possibly leading to stratification in the feed receptacle 28. Instead of a well-mixed feed, the operators experience feed "layers" with somewhat different properties. The property changes affect the operation of the centrifuge 12. For this example we assume that the cold feed temperature charge (T1) is measured as −4° F. We assume that the fuzzy soft-sensor 36 detects a change in the feed solid content of +2% and a change in the feed water content of +6%. From FIG. 10A, the change in feed water content has a membership of 0.3 in "Positive" and 0.7 in "Zero". From FIG. 10B, the change in feed solid content has a membership of 0.2 in "Positive" and 0.8 in "Zero". From FIG. 10C, the change in cold feed temperature has a membership of 0.6 in "Zero" and 0.04 in "Negative". From Table 5, eight rules are fired. The rules fired are 13, 14, 16, 17, 22, 23, 25, and 26. These rules, with their Min-Max resolution are shown in Table 6. In Table 6 "P", "Z", and "N" stand for "Positive", "Zero", and "Negative" respectively.

TABLE 6

The rules fired for Example 3, with their resolution.

| | If (Feed Water Composition Change) is | and (Feed Solid Composition Change) is | and (Cold Feed Temp. Change) is | Then (Feed Pump Speed Change) is | and Feed Heater Setpoint Change) is |
|---|---|---|---|---|---|
| | Input | | | | |
| Rule No./Value | +6% Membership | +2% Membership | −4° Membership | — Minimum | — Minimum |
| 13 | Z (0.7) | Z (0.8) | N (0.4) | Z (0.4) | P (0.4) |
| 14 | Z (0.7) | Z (0.8) | N (0.6) | Z (0.6) | Z (0.6) |
| 16 | Z (0.7) | P (0.2) | N (0.4) | Z (0.4) | P (0.2) |
| 17 | Z (0.7) | P (0.2) | Z (0.6) | Z (0.2) | Z (0.2) |

TABLE 6-continued

The rules fired for Example 3, with their resolution.

| Rule No./Value | If (Feed Water Composition Change) is | and (Feed Solid Composition Change) is | and (Cold Feed Temp. Change) is | Then (Feed Pump Speed Change) is | and Feed Heater Setpoint Change) is |
|---|---|---|---|---|---|
| | | | Input | | |
| | +6% Membership | +2% Membership | −4° Membership | — Minimum | — Minimum |
| 22 | P (0.3) | Z (0.8) | N (0.4) | Z (0.3) | P (0.3) |
| 23 | P (0.3) | Z (0.8) | Z (0.6) | Z (0.3) | Z (0.3) |
| 25 | P (0.3) | P (0.2) | N (0.4) | Z (0.2) | P (0.2) |
| 26 | P (0.3) | Z (0.2) | Z (0.6) | Z (0.2) | Z (0.2) |
| Maximum Values | | | | Z = 0.6 | P = 0.4 Z – 0.6 |

P = Positive,
Z = Zero,
N = Negative

The rules fired, as shown in Table 3, provide Output 0.4 values of 0.6 for Zero for Feed Pump Speed Change and 0.6 and 0.4 respectively for Positive and Zero for Feed Heater Setpoint Change. The corresponding clipped output memberships functions are shown in FIGS. 11A and 11B.

Figure 11A:
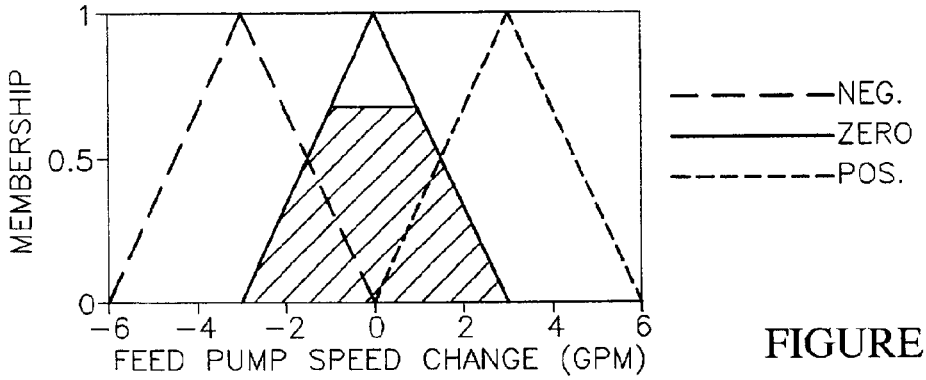
FIG. 11A is a chart illustrating output membership functions for feed pump speed change.
Figure 11B:
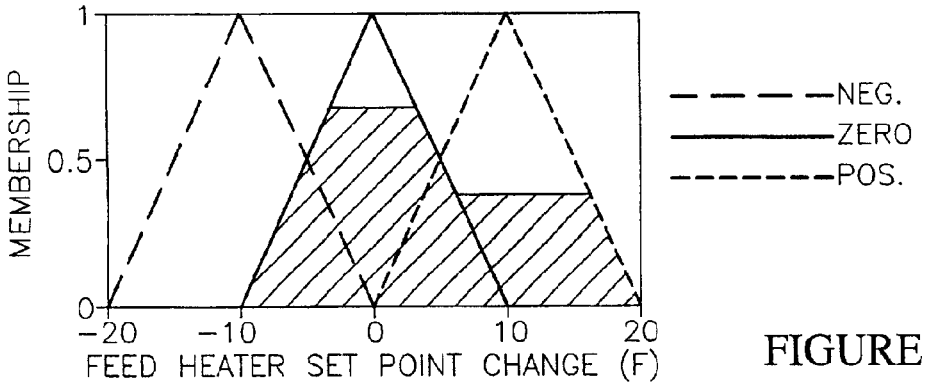
FIG. 11B is a chart illustrating feed heater set point change (° F.)

The centroid of the shaded area in FIG. 11A is 0.0. Therefore the computed Feed Pump Speed Change is zero for this example. The centroid of the shaded area of FIG. 11B is 4.19. Therefore the computer Feed Heater Setpoint Change is 4.19° F. for this example.

Fuzzy Soft Sensor 38

The basic rules for the fuzzy soft sensor 38, are listed in Table 7. Although these rules are illustrative, they can be supplemented or changed using techniques disclosed in the present application.

These rules are of the form:

If the "Feed Pump Flow Change" is . . . and the "Feed BS&W Change" is . . . and the "Feed Heater Power Requirement" is . . . Then the "Feed Water Change" is . . . and the "Feed Solid Change" is . . .

TABLE 7

The basic rules for the fuzzy soft sensor 36.

| Rule # | If (Feed Pump Flow Change) is | & Feed (BS & W Change) is | & (Heater Power Requirememt Change) is | Then (Feed Water is | & (Feed Solid Change) is |
|---|---|---|---|---|---|
| 1 | Large Negative | Negative | Negative | Negative | Negative |
| 2 | Large Negative | Negative | Zero | Negative | Positive |
| 3 | Large Negative | Negative | Positive | Negative | Positive |
| 4 | Large Negative | Zero | Negative | Zero | Zero |
| 5 | Large Negative | Zero | Zero | Negative | Positive |
| 6 | Large Negative | Zero | Positive | Negative | Positive |
| 7 | Large Negative | Positive | Negative | Positive | Positive |
| 8 | Large Negative | Positive | Zero | Negative | Positive |
| 9 | Large Negative | Positive | Positive | Zero | Positive |
| 10 | Small Negative | Negative | Negative | Negative | Negative |
| 11 | Small Negative | Negative | Zero | Negative | Negative |
| 12 | Small Negative | Negative | Positive | Negative | Positive |
| 13 | Small Negative | Zero | Negative | Zero | Zero |
| 14 | Small Negative | Zero | Zero | Zero | Zero |
| 15 | Small Negative | Zero | Positive | Negative | Positive |
| 16 | Small Negative | Positive | Negative | Zero | Positive |
| 17 | Small Negative | Positive | Zero | Positive | Positive |
| 18 | Small Negative | Positive | Positive | Positive | Positive |
| 19 | Zero | Negative | Negative | Negative | Negative |
| 20 | Zero | Negative | Zero | Zero | Negative |
| 21 | Zero | Negative | Positive | Positive | Negative |
| 22 | Zero | Zero | Negative | Zero | Zero |
| 23 | Zero | Zero | Zero | Zero | Zero |
| 24 | Zero | Zero | Positive | Positive | Negative |
| 25 | Zero | Positive | Negative | Zero | Negative |
| 26 | Zero | Positive | Zero | Positive | Positive |
| 27 | Zero | Positive | Positive | Positive | Positive |
| 28 | Small Positive | Negative | Negative | Negative | Zero |
| 29 | Small Positive | Negative | Zero | Negative | Negative |
| 30 | Small Positive | Negative | Positive | Zero | Negative |
| 31 | Small Positive | Zero | Negative | Zero | Zero |

TABLE 7-continued

The basic rules for the fuzzy soft sensor 36.

| Rule # | If (Feed Pump Flow Change) is | & Feed (BS & W Change) is | & (Heater Power Requirememt Change) is | Then (Feed Water is | & (Feed Solid Change) is |
|---|---|---|---|---|---|
| 32 | Small Positive | Zero | Zero | Zero | Zero |
| 33 | Small Positive | Zero | Positive | Zero | Zero |
| 34 | Small Positive | Positive | Negative | Zero | Positive |
| 35 | Small Positive | Positive | Zero | Negative | Positive |
| 36 | Small Positive | Positive | Positive | Positive | Zero |
| 37 | Large Positive | Negative | Negative | Negative | Negative |
| 38 | Large Positive | Negative | Zero | Negative | Negative |
| 39 | Large Positive | Negative | Positive | Positive | Negative |
| 40 | Large Positive | Zero | Negative | Zero | Zero |
| 41 | Large Positive | Zero | Zero | Zero | Zero |
| 42 | Large Positive | Zero | Positive | Positive | Negative |
| 43 | Large Positive | Positive | Negative | Zero | Positive |
| 44 | Large Positive | Positive | Zero | Positive | Positive |
| 45 | Large Positive | Positive | Positive | Positive | Negative |

In order to implement the above rules, crisp rules and a branch and bound technique can be used to choose the rules that will be used for a given condition. For example we can obtain 27 branch points from the original 45 rules. The desired branch point is chosen using "crisp" values of the input variables "Pump Flow Change", "BS&W Change", and "Heater Power Requirement Change". From the branch point we step to a fuzzy control routine that manages the fuzzy rules under the branch. The crisp rules for the 27 branch points are listed in Table 8. These rules are of the form:

If "Pump Flow Change" is . . . and "BS&W Change" is . . . and "Heater Power Requirement" is . . . then Go to . . .

TABLE 8

Branch points for the fuzzy soft sensor rule base.

| Branch point | if (Pump Flow Change) is | and (BS & W Change) is | and (Heater Power Requirement Change) is | Then (GO to . . . ) |
|---|---|---|---|---|
| 1 | Negative | Negative | Negative | Fuzzy system 1 |
| 2 | Negative | Negative | Zero | Fuzzy system 2 |
| 3 | Negative | Negative | Positive | Fuzzy system 3 |
| 4 | Negative | Zero | Negative | Fuzzy system 4 |
| 5 | Negative | Zero | Zero | Fuzzy system 5 |
| 6 | Negative | Zero | Positive | Fuzzy system 6 |
| 7 | Negative | Positive | Negative | Fuzzy system 7 |
| 8 | Negative | Positive | Zero | Fuzzy system 8 |
| 9 | Negative | Positive | Positive | Fuzzy system 9 |
| 10 | Zero | Negative | Negative | Fuzzy system 10 |
| 11 | Zero | Negative | Zero | Fuzzy system 11 |
| 12 | Zero | Negative | Positive | Fuzzy system 12 |
| 13 | Zero | Zero | Negative | Fuzzy system 13 |
| 14 | Zero | Zero | Zero | Fuzzy system 14 |
| 15 | Zero | Zero | Positive | Fuzzy system 15 |
| 16 | Zero | Positive | Negative | Fuzzy system 16 |
| 17 | Zero | Positive | Zero | Fuzzy system 17 |
| 18 | Zero | Positive | Positive | Fuzzy system 18 |
| 19 | Positive | Negative | Negative | Fuzzy system 19 |
| 20 | Positive | Negative | Zero | Fuzzy system 20 |
| 21 | Positive | Negative | Positive | Fuzzy system 21 |
| 22 | Positive | Zero | Negative | Fuzzy system 22 |
| 23 | Positive | Zero | Zero | Fuzzy system 23 |
| 24 | Positive | Zero | Positive | Fuzzy system 24 |
| 25 | Positive | Positive | Negative | Fuzzy system 25 |

TABLE 8-continued

Branch points for the fuzzy soft sensor rule base.

| Branch point | if (Pump Flow Change) is | and (BS & W Change) is | and (Heater Power Requirement Change) is | Then (GO to . . . ) |
|---|---|---|---|---|
| 26 | Positive | Positive | Zero | Fuzzy system 26 |
| 27 | Positive | Positive | Positive | Fuzzy system 27 |

Figure 12:
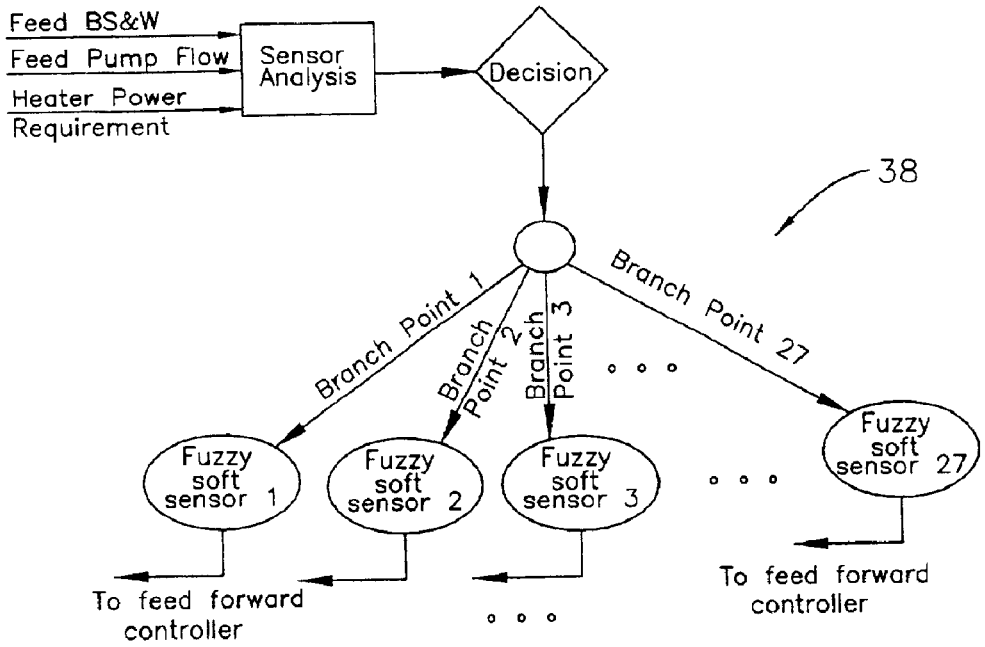
FIG. 12 is a flow diagram illustrating operation of a fuzzy soft sensor of the fuzzy logic control system.

FIG. 12 illustrates the use of the Table 8

The soft sensor rules (1–27) currently are all different. Some are very simple and some are reasonably complicated, using many of the original 45 rules with modified membership functions. In addition to the variables shown above, Feed BS&W, Feed Pump Flow, and Heater Power Requirement, Feed Temperature Change are taken into account. As well, each rule system must take into account whether the continuous phase is oil or water. If water is the continuous phase, oil droplets are dispersed throughout the water phase. If oil is the continuous phase water droplets are dispersed through the oil phase. The physical properties of the system, especially viscosity, strongly depend upon which phase is the continuous one.

Thus the invention provides an improved system and process for separating a multi chase mixture into separate components. Although the invention has been described with reference to certain preferred embodiments, as will be apparent to those skilled in the art, certain changes and modifications can be made without departing from the scope of the invention as defined by the following claims.

We claim:

1. A system for separating a multi phase mixture comprising:

a centrifuge configured to separate the mixture into a first liquid phase component, a second liquid phase component and a solid phase component; and a control system programmed with a set of fuzzy logic rules;

the control system configured to sense feed variables of the mixture into the centrifuge and at least one parameter of the first liquid phase component or the second liquid phase component and to adjust a feed temperature and a feed rate of the mixture based on the variables, the parameter and the set of fuzzy logic rules.

2. The system of claim 1 wherein the control system further comprises a filter configured to differentiate signals representative of the feed variable from noise.

3. The system of claim 1 wherein the control system further comprises a conflict resolution portion configured to resolve conflicts during adjusting of the feed temperature and the feed rate.

4. The system of claim 3 wherein the mixture comprises an oil emulsion, the first liquid phase component comprises oil and the second liquid phase component comprises water.

5. A system for separating a multi phase mixture comprising:

a centrifuge configured to separate the mixture into a first liquid phase component, a second liquid phase component and a solid phase component;

a feed forward control system comprising a plurality of sensors, a fuzzy soft sensor in signal communication with the sensors programmed with a set of fuzzy logic rules, and a controller in signal communication with the fuzzy soft sensor, the feed forward control system configured to sense feed variables of the mixture into the centrifuge and to adjust a feed temperature and a feed rate of the mixture based on the feed variables and the set of fuzzy logic rules; and a feedback control system configured to measure feedback variables in the first liquid phase component or the second liquid phase component and to adjust the feed temperature and the feed rate based on the feedback variables and the set of fuzzy logic rules;

the feedback control system comprising a feedback controller including a conflict resolution portion configured to coordinate the operation of the controller and the feedback controller.

6. The system of claim 5 wherein the feedback control system includes a BS&W sensor configured to measure a basic solids and water content of the first liquid phase component and to adjust the feed temperature and the feed rate based on the basic solids and water content and the set of fuzzy logic rules.

7. The system of claim 5 wherein the feed variables include a feed temperature and a feed rate.

8. The system of claim 5 wherein the feed variables include a feed temperature, a feed rate, a percent change of water and a percent change of solid expressed as a single feed magnitude change variable.

9. A system for separating a multi phase mixture comprising:

a centrifuge configured to separate the mixture into a first liquid phase component, a second liquid phase component and a solid phase component;

a feed forward control system comprising a plurality of sensors, a fuzzy soft sensor in signal communication with the sensors programmed with a set of fuzzy logic rules, and a controller in signal communication with the fuzzy soft sensor, the feed forward control system configured to sense feed variables of the mixture into the centrifuge and to adjust a feed temperature and a feed rate of the mixture based on the feed variables and the set of fuzzy logic rules; and a filter in signal communication with the fuzzy soft sensor configured to differentiate signals representative of the feed variables from noise.

10. The system of claim 9 further comprising a heater in signal communication with the controller configured to heat the mixture to the feed temperature and a pump in signal communication with the controller configured to pump the mixture into the centrifuge at the feed rate.

11. The system of claim 9 wherein the mixture comprises an oil emulsion, the first liquid phase component comprises oil and the second liquid phase component comprises water.

12. A system for separating a multi phase mixture comprising:

a centrifuge configured to separate the mixture into a first liquid phase component, a second liquid phase component and a solid phase component;

a heater configured to heat the mixture to a temperature set point (T2);

a pump configured to pump the mixture into the centrifuge;

a fuzzy soft sensor in signal communication with a first sensor configured to sense a feed temperature (T1) of the mixture and a second sensor configured to sense a basic solids and water content of the mixture;

a set of fuzzy logic rules programmed into the fuzzy soft sensor and configured to express input from the first sensor and the second sensor into at least one feed change variable; and a controller in signal communication with the fuzzy soft sensor configured to adjust the temperature set point (T2) for the mixture, and to adjust a speed of the pump to achieve a selected feed rate for the mixture.

13. The system of claim 12 further comprising a third sensor configured to measure a basic solids and water content of the first liquid phase component, and a feedback controller in signal communication with the third sensor configured to adjust the temperature set point (T2) and the speed of the pump based on the rules and input from the third sensor.

14. The system of claim 12 wherein the mixture comprises an oil emulsion, the first liquid phase component comprises oil and the second liquid phase component comprises water.

15. The system of claim 12 wherein the centrifuge comprises a rotatable bowl for separating the first liquid phase component and the second liquid phase component and an auger for separating the solid phase component.

16. The system of claim 12 wherein the centrifuge includes a tank configured to collect the first liquid phase component and a vapor recovery unit configured to collect and condense vapor from the tank.

17. The system of claim 16 wherein the vapor recovery unit comprises a fan configured to move the vapor and a plurality of baffles configured to condense the vapor.

18. The system of claim 12 wherein the rules are in an "if" "then" format.

19. A process for separating a multi phase mixture comprising:

providing a centrifuge configured to separate the mixture into a first liquid phase component, a second liquid phase component and a solid phase component; and providing a fuzzy soft sensor programmed with a set of fuzzy logic rules;

sensing at least one feed variable of the mixture and at least one parameter of the first liquid chase component or the second liquid phase component; and adjusting a feed temperature and a feed rate of the mixture into the centrifuge based on the feed variable, the parameter and the set of fuzzy logic rules.

20. The process of claim 19 wherein the feed variable is selected from the group consisting of the feed temperature, a percent change of water and a percent change of solid of the mixture.

21. The process of claim 19 wherein the feed variable comprises a percent change of solid expressed as a single feed magnitude change variable.

22. The process of claim 19 further comprising resolving conflicts from the sensing step prior to performing the adjusting step.

23. The process of claim 19 wherein the mixture comprises an oil emulsion, the first liquid phase component comprises oil and the second liquid phase component comprises water.

24. A process for separating a multi phase mixture comprising:

providing a centrifuge configured to separate the mixture into a first liquid phase component, a second liquid phase component and a solid phase component;

providing a feed pump configured to pump the mixture into the centrifuge at a feed rate;

providing a heater configured to heat the mixture to a temperature set point;

providing a fuzzy soft sensor programmed with a set of fuzzy logic rules that relate a feed water composition change of the mixture, a feed solid composition change of the mixture, and a cold feed temperature change of the mixture to a feed pump speed change for the feed pump, and to a heater setpoint change for the heater;

sensing the basic solids and water content of the mixture and the cold feed temperature;

filtering signals representative of the basic solids and water content and the cold feed temperature from noise;

relating the basic solids and water content to the feed water composition change and to the feed solid composition change; and adjusting the feed rate and the temperature set point using the rules, the sensing step, the filtering step and the relating step.

25. The process of claim 24 wherein the mixture comprises an oil emulsion, the first liquid phase component comprises oil and the second liquid phase component comprises water.

26. The process of claim 24 further comprising sensing a basic solids and water content of the first liquid phase component to provide feedback data and adjusting the feed rate and the temperature set point using the feedback data.

27. The process of claim 24 further comprising sensing an oil content of the second liquid phase component to provide additional feedback date and adjusting the feed rate and the temperature set point using the additional feedback data.

28. The process of claim 24 further comprising collecting the first liquid phase component in a tank, collecting the vapor from the tank, and condensing the vapor.

29. The process of claim 28 further comprising providing a vapor recovery unit comprising a fan configured to move the vapor and a plurality of baffles configured to condense the vapor.

* * * * *